US011835911B2

(12) United States Patent
Sato et al.

(10) Patent No.: US 11,835,911 B2
(45) Date of Patent: Dec. 5, 2023

(54) IMAGE FORMING SYSTEM WITH COVERED ACCOMMODATING PORTION FOR A CABLE THAT CONNECTS AN OPERATING UNIT TO ELECTRIC POWER

(71) Applicant: CANON KABUSHIKI KAISHA, Tokyo (JP)

(72) Inventors: Osamu Sato, Tokyo (JP); Hiromichi Koseki, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/853,781

(22) Filed: Jun. 29, 2022

(65) Prior Publication Data

US 2022/0326650 A1 Oct. 13, 2022

Related U.S. Application Data

(62) Division of application No. 17/208,862, filed on Mar. 22, 2021, now Pat. No. 11,402,789.

(30) Foreign Application Priority Data

Mar. 30, 2020 (JP) ..... 2020-060758

(51) Int. Cl.
*G03G 15/00* (2006.01)
*G03G 21/18* (2006.01)
*G03G 21/16* (2006.01)

(52) U.S. Cl.
CPC ..... *G03G 15/80* (2013.01); *G03G 21/1619* (2013.01); *G03G 21/1633* (2013.01); *G03G 21/1878* (2013.01)

(58) Field of Classification Search
CPC ..... G03G 15/80; G03G 21/1619; G03G 21/1633; G03G 21/1878
See application file for complete search history.

(56) References Cited

U.S. PATENT DOCUMENTS

| | | | | |
|---|---|---|---|---|
| 11,402,789 | B2 * | 8/2022 | Sato | G03G 15/80 |
| 2009/0073478 | A1 | 3/2009 | Takuwa | 358/1.13 |
| 2016/0085200 | A1 | 3/2016 | Fujita et al. | 399/90 |
| 2017/0343952 | A1 | 11/2017 | Tokumoto et al. | G03G 21/1661 |

FOREIGN PATENT DOCUMENTS

| | | |
|---|---|---|
| JP | 2005-019924 | 1/2005 |
| JP | 2010-243977 | 10/2010 |
| JP | 2020-046535 | 3/2020 |

* cited by examiner

*Primary Examiner* — Sandra Brase
(74) *Attorney, Agent, or Firm* — Venable LLP

(57) ABSTRACT

An image forming system includes an openable portion, an operating unit, a cable, an accommodating portion, a cable cover, a retaining portion, and an opening. When the cable cover is viewed along a vertical direction, an edge portion of the opening and an end portion of the cable are defined, specifically, the opening defines an edge portion of an edge of the opening on a side where the openable portion is positioned with respect to a left-right direction, and the cable defines an end portion of an outer peripheral surface of the cable retained by the retaining portion with respect to the left-right direction. With respect to the left-right direction, the edge portion is positioned further on a side opposite from the side where the openable portion is positioned than the end portion is.

7 Claims, 13 Drawing Sheets

(a)

(b)

(a)

(b)

IMAGE FORMING SYSTEM WITH COVERED ACCOMMODATING PORTION FOR A CABLE THAT CONNECTS AN OPERATING UNIT TO ELECTRIC POWER

This application is a division of application Ser. No. 17/208,862 filed Mar. 22, 2021, currently pending, and claims priority under 35 U.S.C. § 119 from Japan application No. 2020-060758 filed in Japan on Mar. 30, 2020; the content of all of which are incorporated herein by reference as if set forth in full.

FIELD OF THE INVENTION AND RELATED ART

The present invention relates tan image forming system including an operating unit freely mountable on a top surface of the image forming system.

An image forming apparatus such as a copying machine includes the operating unit for permitting a user to switch an operation and to make detailed settings in various operation, and the like. Also, in a system (image forming system) in which various option devices such as a sheet (paper) feeding unit, a conveying unit and a post-processing unit are connected to the image forming apparatus, the user performs a setting operation of the various option devices by the operating unit.

Incidentally, in the case of a large-size image forming system in which the plurality of option devices are connected to the image forming apparatus and which has a long full-length as described above, the user performs an operation for the option devices in a place distant from the image forming apparatus provided with the operating unit in some instances. It is troublesome that the user comes and go between these option devices every time when the user operates the option devices and the operating unit.

Therefore, for example, an operating unit provided not only on an image forming apparatus but also on option devices has also been disclosed (Japanese Laid-Open Patent Application (JP-A) 2010-243977). The operating unit disclosed in JP-A 2010-243977 includes a display information for a user, an arm supporting the display, and a supporting table for supporting the display through the arm. To the display, a cable is connected, and supply of electric power to the display and transmission of signals used for communication are carried out through the cable. The user is capable of freely mounting the operating unit on the image forming apparatus and the option devices within an allowable range of a length of the cable.

However, depending on the image forming system, on the top surface, a reading device (reader) or a bottle accommodating portion for accommodating toner bottles is provided (mounted) in some instances. The reader or the bottle accommodating portion is provided an openable portion which is a cover for opening and closing the reader or the bottle accommodating portion. However, in a constitution in which the operating unit as described above is freely mountable on the top surface of the image forming system, there was a liability that the cable connected to the operating unit is caught by the openable portion.

SUMMARY OF THE INVENTION

According to an aspect of the present invention, there is provided an image forming system having a top surface, comprising: an openable portion configured to open and close a reader for reading an image of an original, the reader being provided on the top surface; an operating unit freely mounted on the top surface and configured to receive an operation by a user; a cable connected to the operating unit and configured to supply electric power to the operating unit; an accommodating portion configured to accommodate the cable, wherein when the top surface is viewed along a vertical direction, the accommodating portion is formed on the top surface along a first direction from a rear surface toward a front surface of the image forming system and formed on the top surface in parallel to the openable portion with respect to a second direction perpendicular to the first direction and the vertical direction; a cable cover configured to cover the accommodating portion accommodating the cable; a retaining portion configured to retain the cable inside the accommodating portion; and an opening formed on a front side of the cable cover, the opening permitting leading-out of the cable to an outside of the accommodating portion, wherein when the cable cover is viewed along the vertical direction, an edge portion of an edge of the opening on a side where the openable portion is positioned with respect to the second direction is positioned on a side opposite from the side where the openable portion is positioned with respect to the second direction when an end portion, on the side where the openable portion is positioned, of an outer peripheral surface of the cable retained by the retaining portion with respect to the second direction is.

According to another aspect of the present invention, there is provided an image forming system having a top surface, comprising: an openable portion configured to open and close a bottle accommodating portion for accommodating a toner bottle, the bottle accommodating portion being provided on the top surface; an operating unit freely mounted on the top surface and configured to receive an operation by a user; a cable connected to the operating unit and configured to supply electric power to the operating unit; an accommodating portion configured to accommodate the cable, wherein when the top surface is viewed along a vertical direction, the accommodating portion is formed on the top surface along a first direction from a rear surface toward a front surface of the image forming system and formed on the top surface in parallel to the openable portion with respect to a second direction perpendicular to the first direction and the vertical direction; a cable cover configured to cover the accommodating portion accommodating the cable; a retaining portion configured to retain the cable inside the accommodating portion; and an opening formed on a front side of the cable cover, the opening permitting leading-out of the cable to an outside of the accommodating portion, wherein when the cable cover is viewed along the vertical direction, an edge portion of an edge of the opening on a side where the openable portion is positioned with respect to the second direction is positioned on a side opposite from the side where the openable portion is positioned with respect to the second direction when an end portion, on the side where the openable portion is positioned, of an outer peripheral surface of the cable retained by the retaining portion with respect to the second direction is.

Further features of the present invention will become apparent from the following description of exemplary embodiments with reference to the attached drawings.

Figure 2:
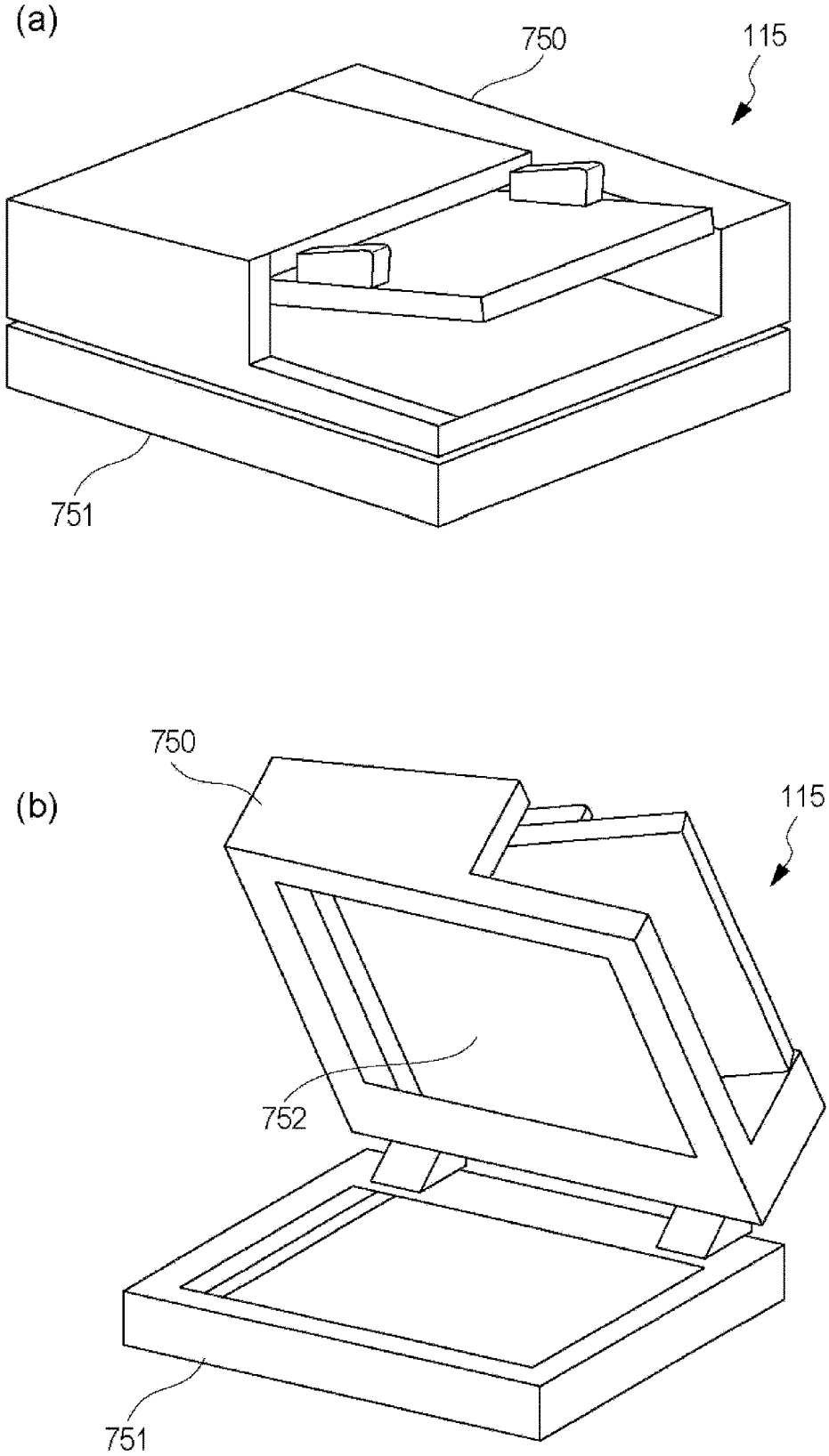

Parts (a) and (b) of FIG. 2 are perspective views of a scanner unit.

Figure 3:
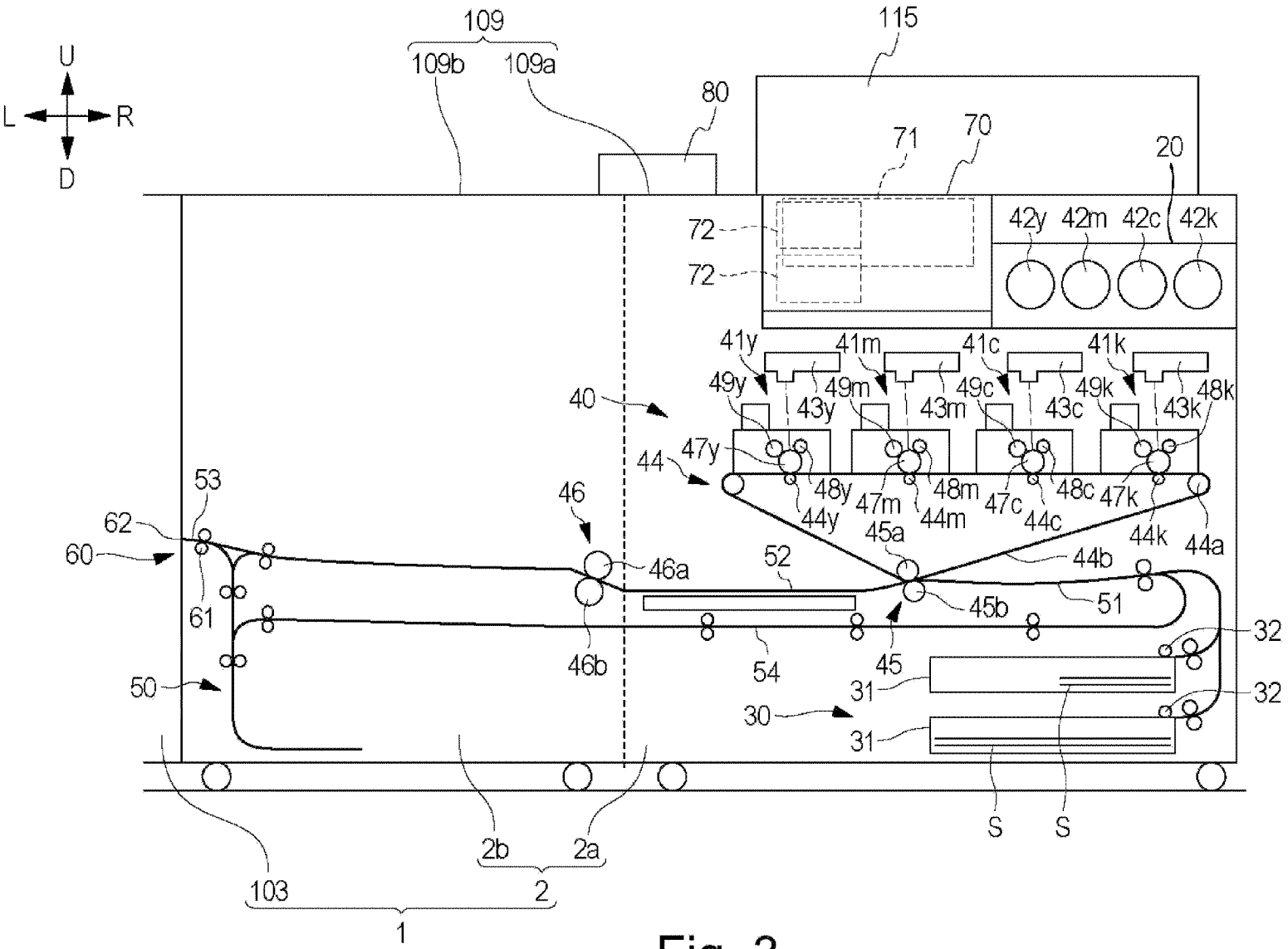

FIG. 3 is a schematic sectional view of a part of the image forming system.

Figure 4:
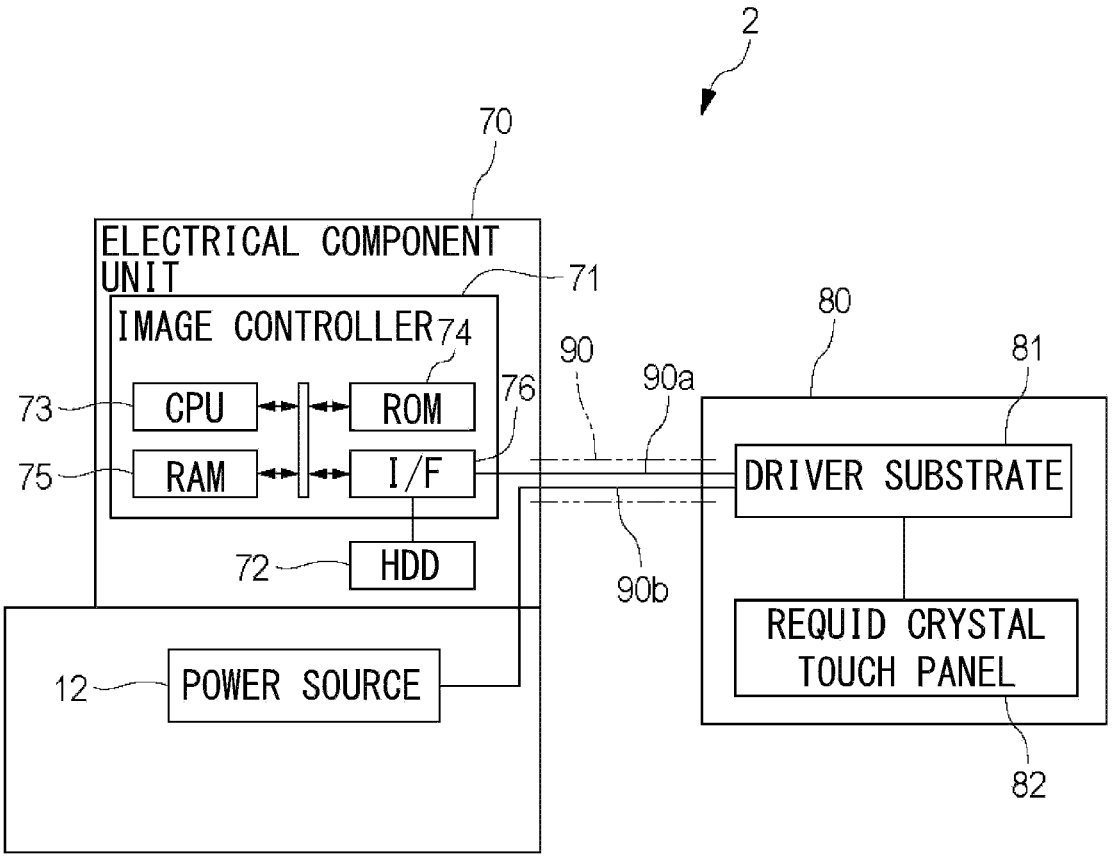

FIG. 4 is a schematic view for illustrating a control constitution of an operating unit by the image forming system.

Figure 5:
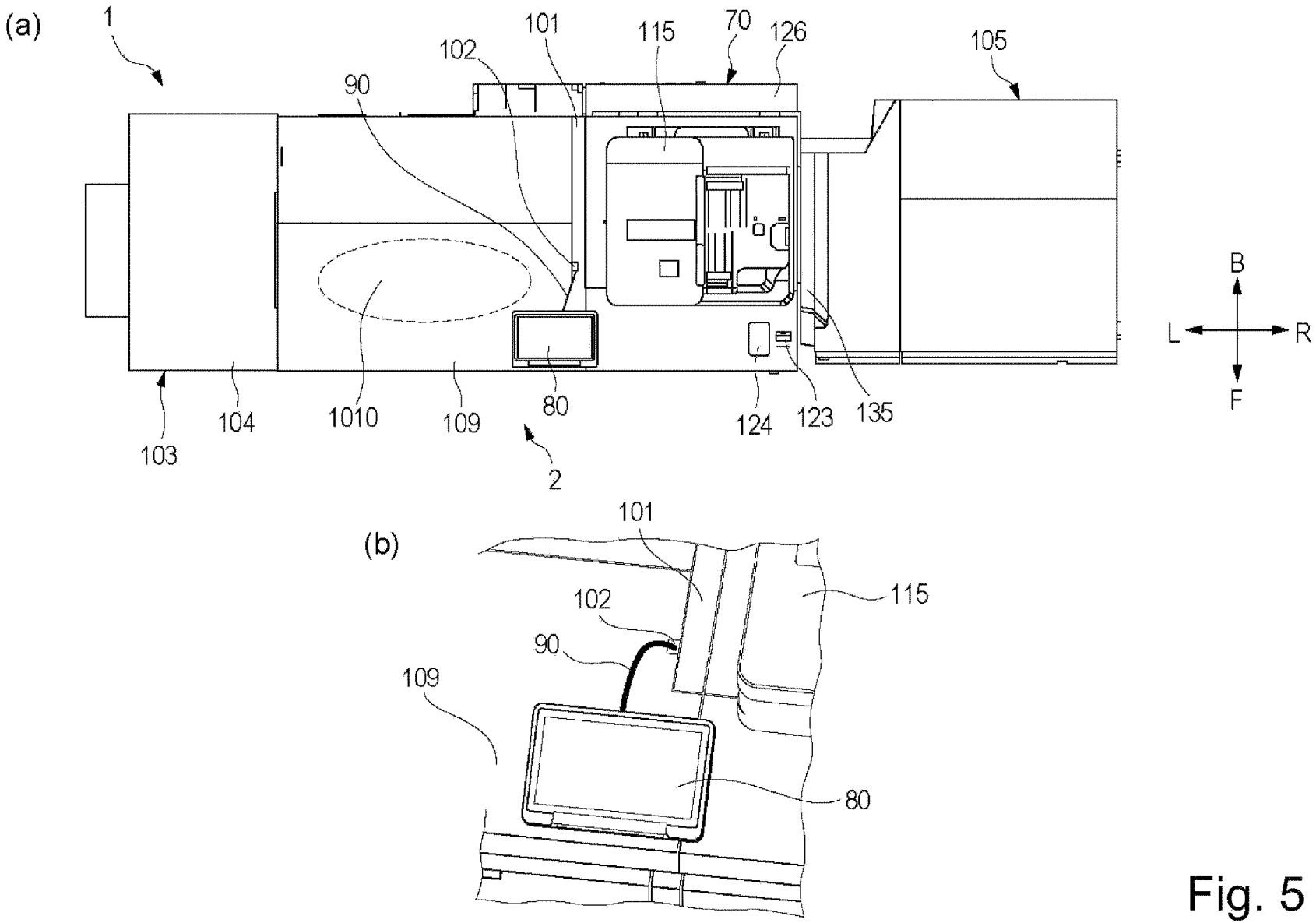

Parts (a) and (b) of FIG. 5 are schematic views for illustrating a state in which the operating unit is mounted on a top surface of the image forming system.

Figure 6:
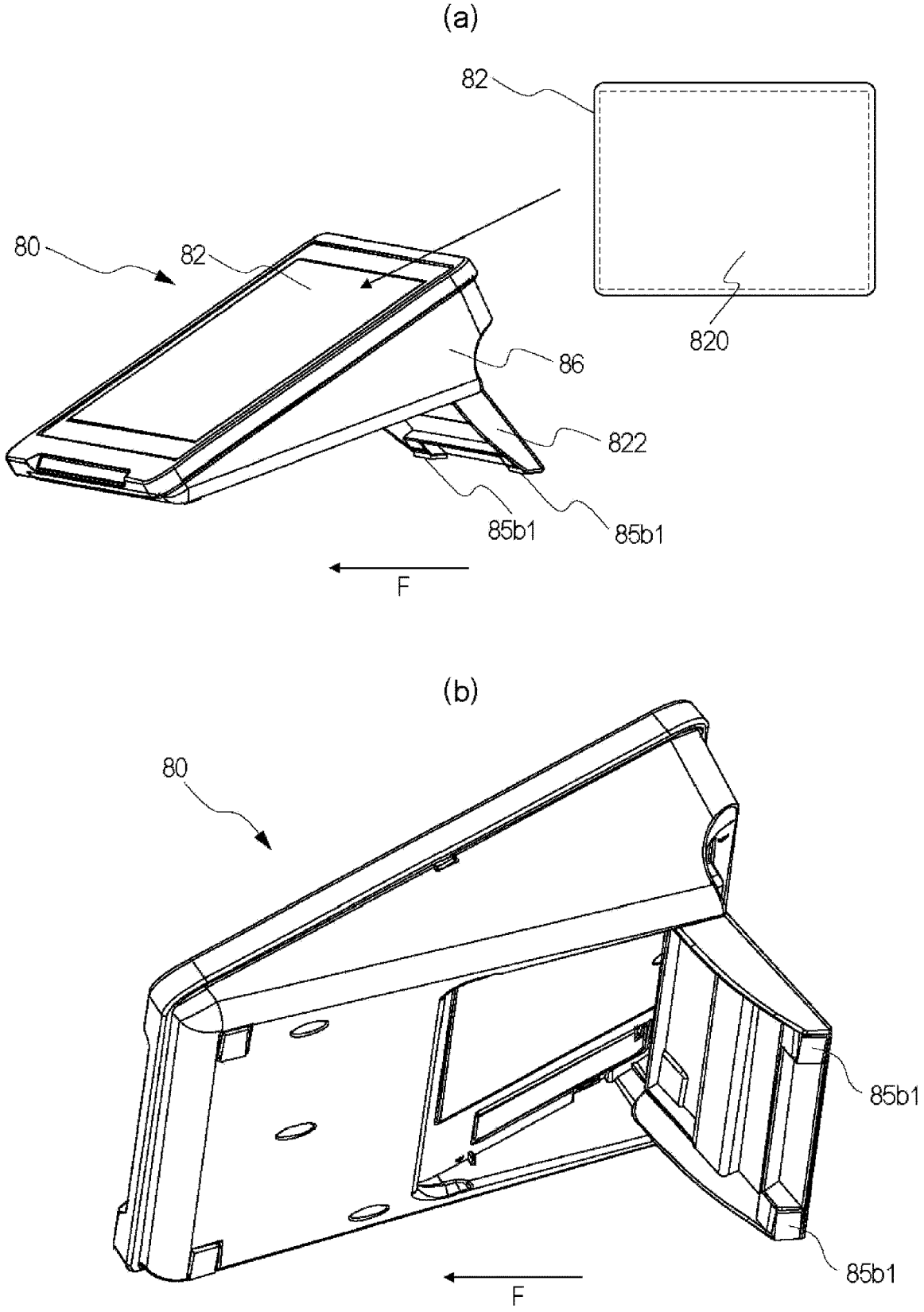

Parts (a) and (b) of FIG. 6 are schematic views for illustrating the operating unit.

Figure 7:
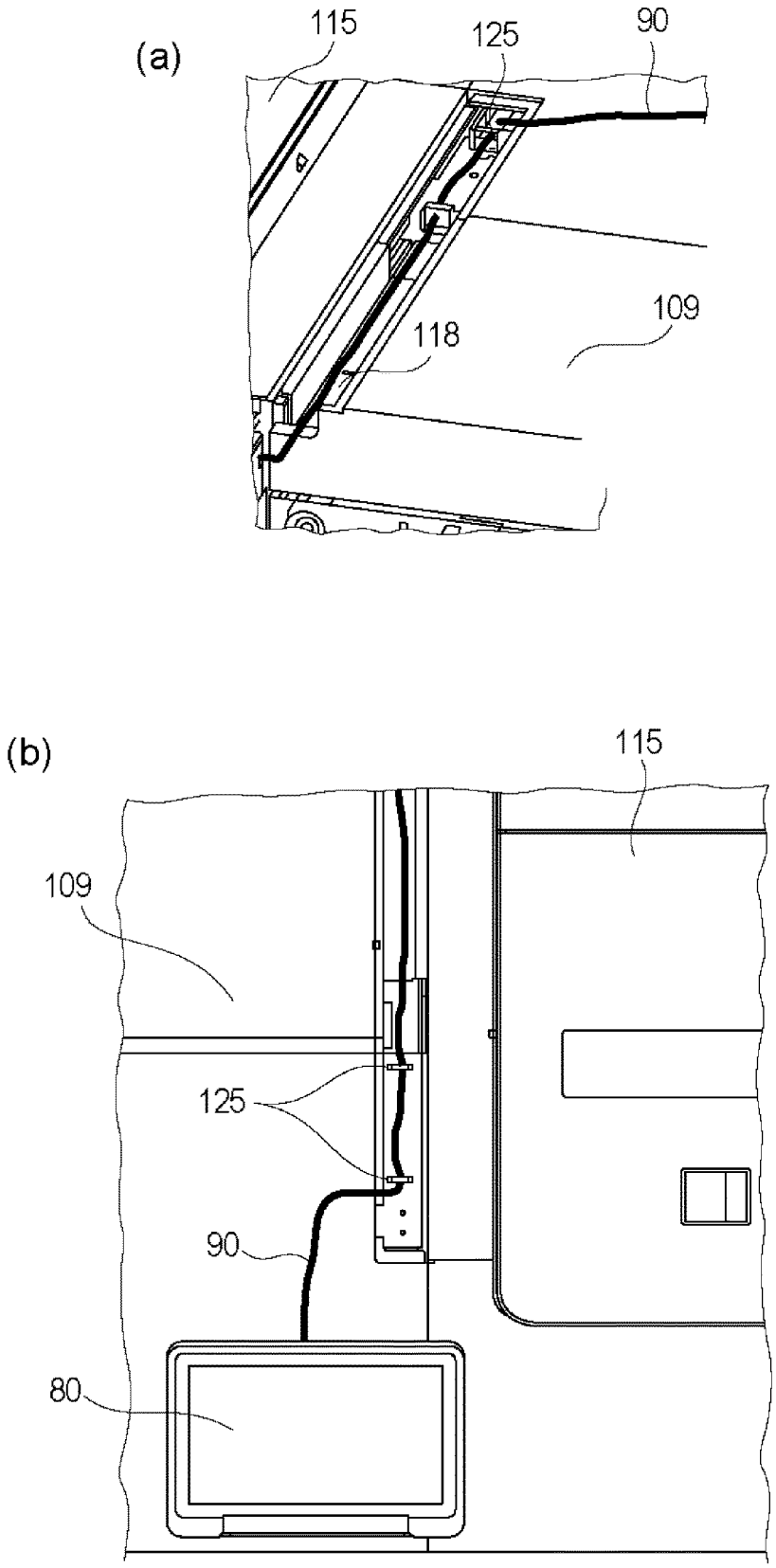

Parts (a) and (b) of FIG. 7 are schematic views for illustrating a cable accommodating portion.

Figure 8:
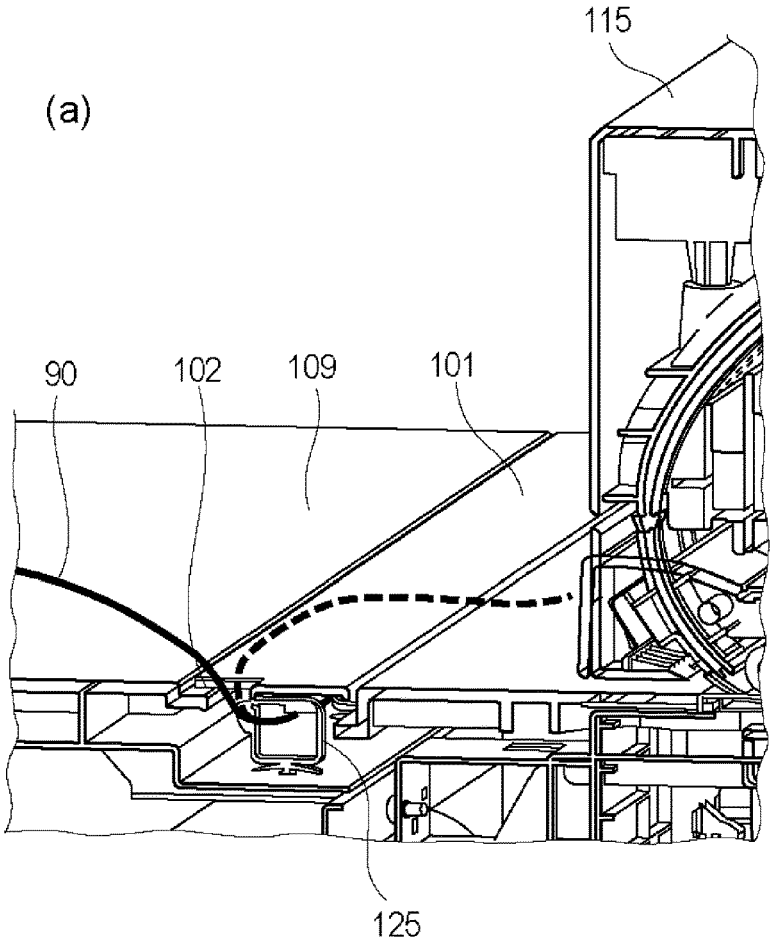
Figure 8:
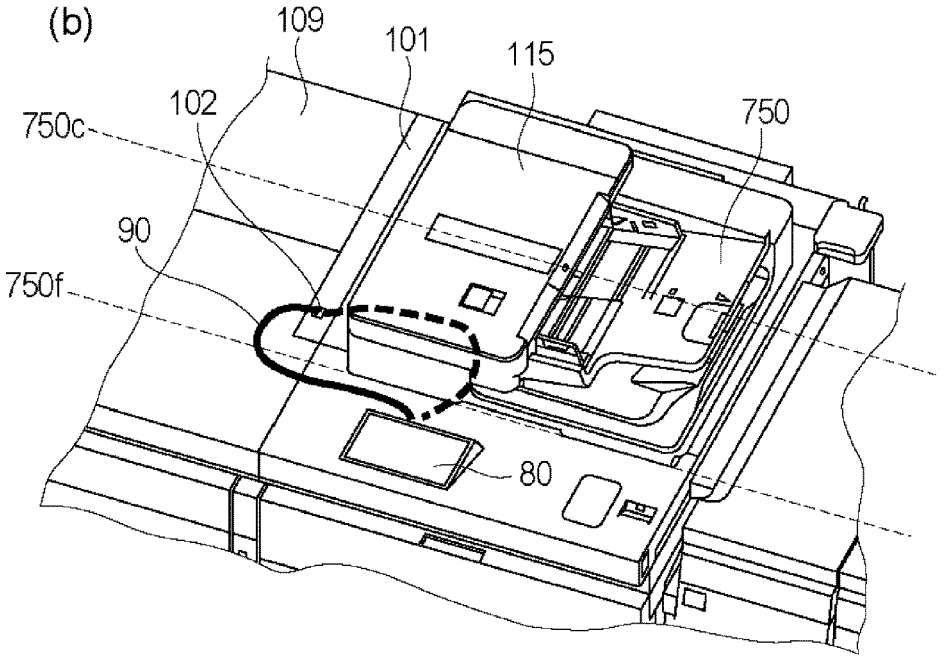

Parts (a) and (b) of FIG. 8 are schematic views for illustrating a positional relationship between an opening and a retaining portion.

Figure 9:
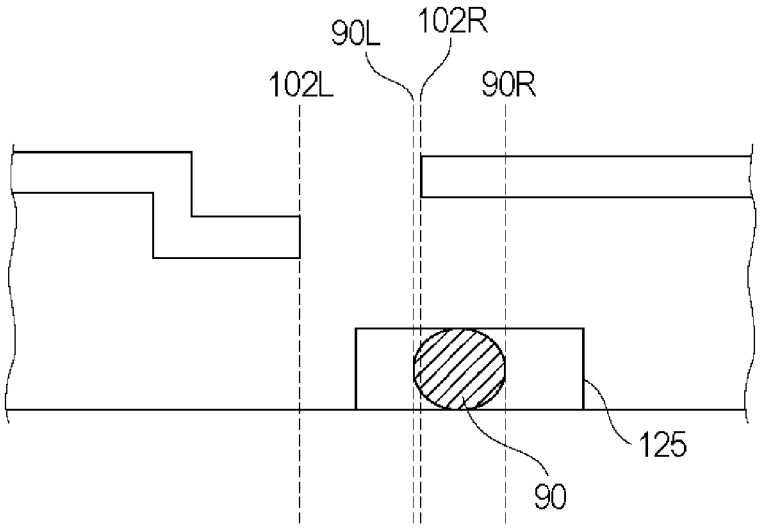
Figure 9:
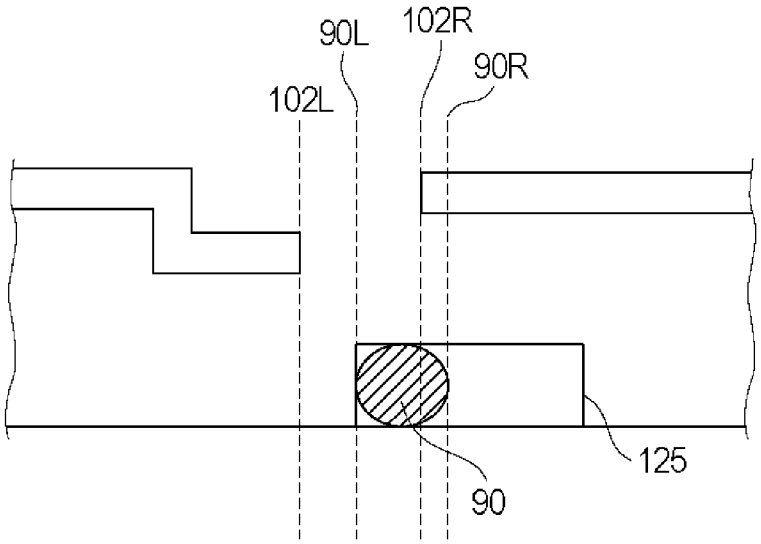

Parts (a) and (b) of FIG. 9 are schematic views for illustrating a positional relationship between a retaining portion and a cable.

Figure 10:
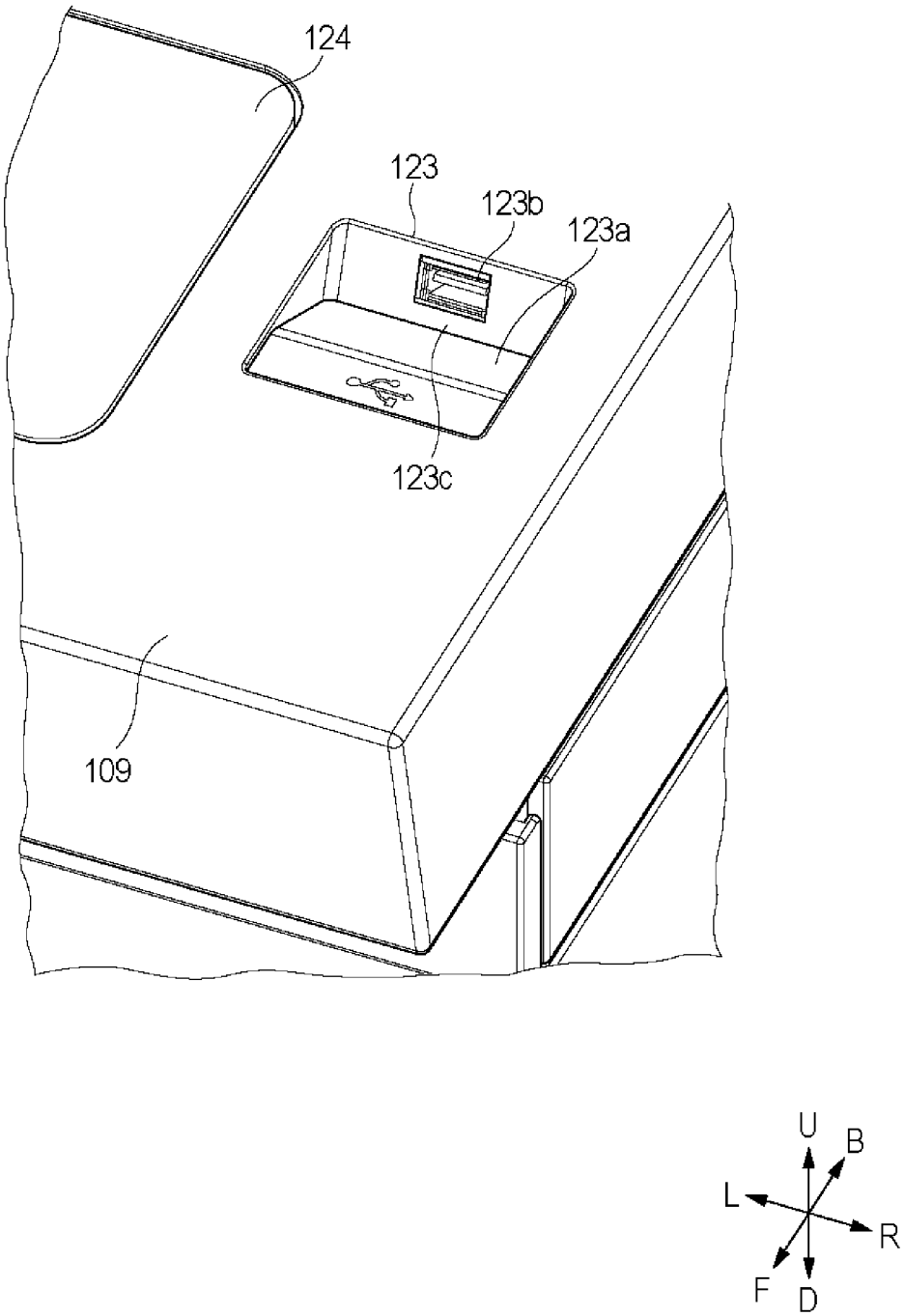

FIG. 10 is a perspective view of a portion where a USB memory is connected.

Figure 11:
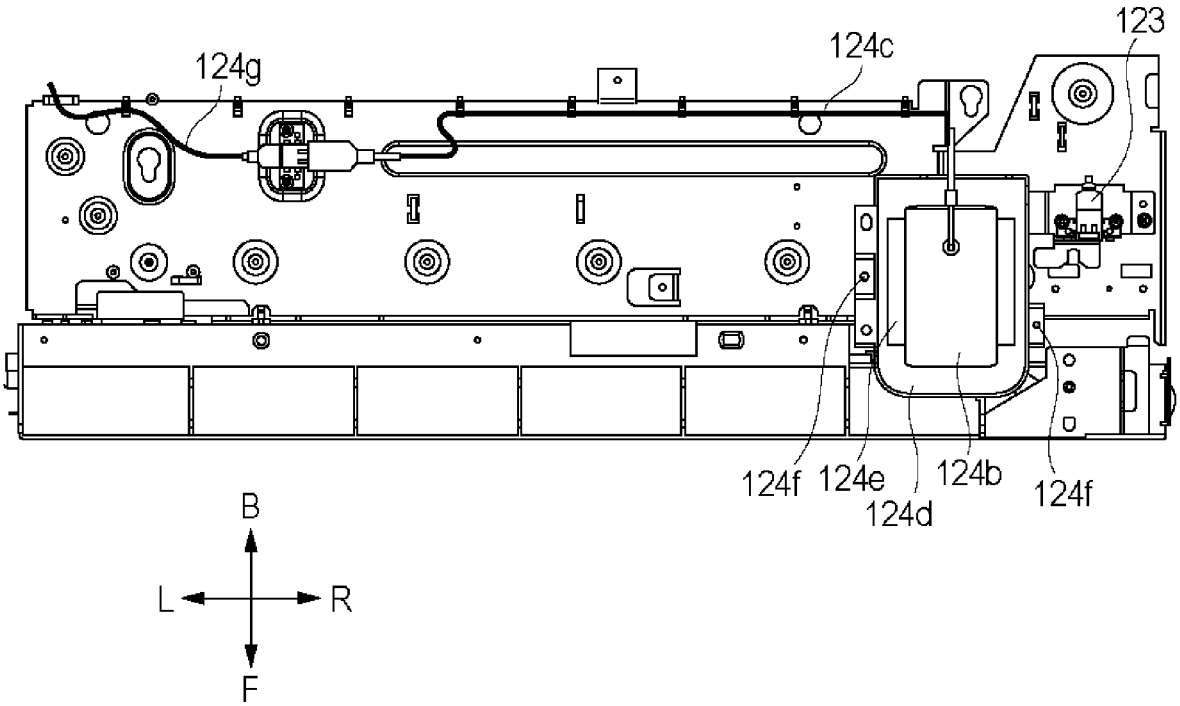
Figure 11:
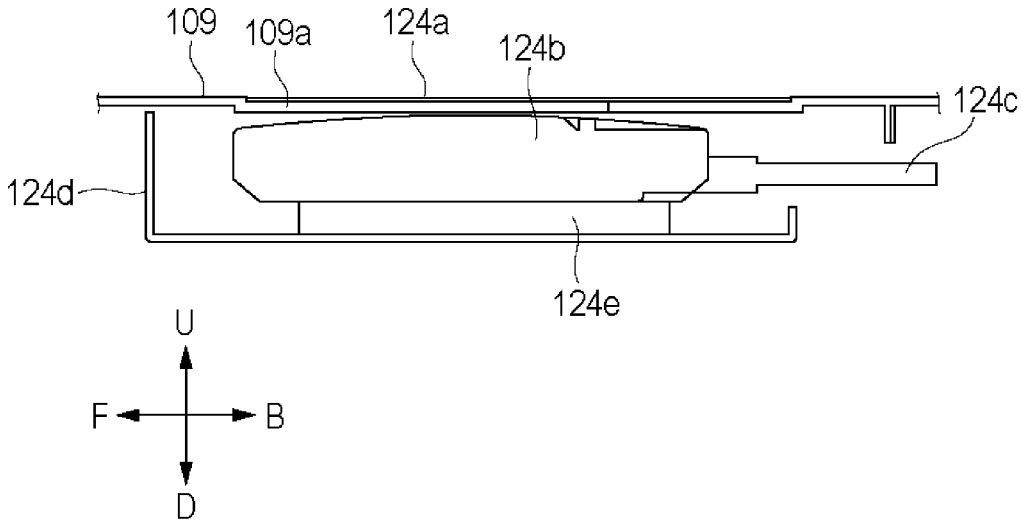

Parts (a) and (b) of FIG. 11 are schematic views for illustrating a positional relationship between a card reader for authentication and a USB memory inserting portion.

Figure 12:
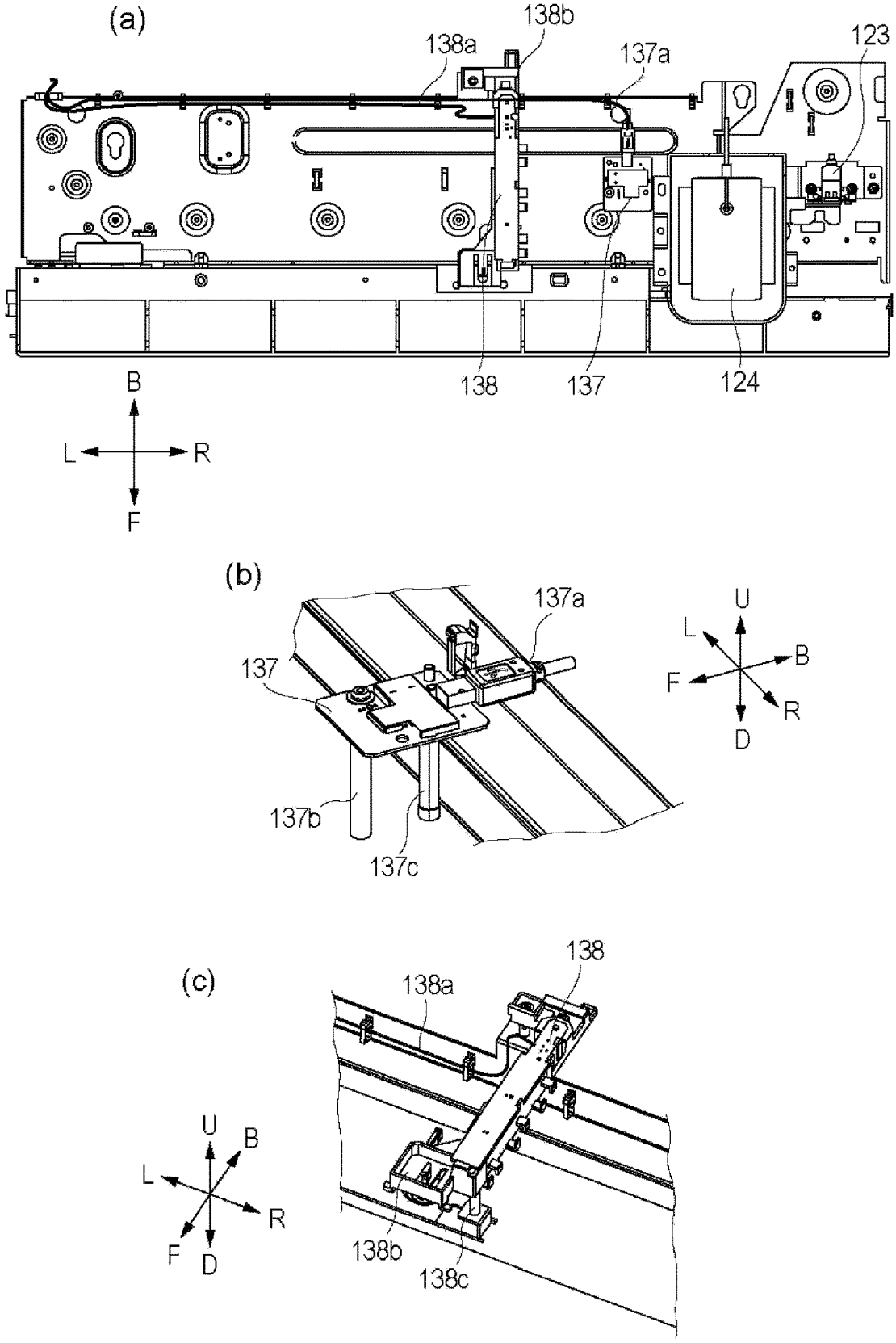

Parts (a), (b) and (c) of FIG. 12 are schematic views for illustrating a positional relationship between a portion where BLE authentication is performed, a portion where authentication is performed by a card for the authentication, and the USB memory inserting portion.

Figure 13:
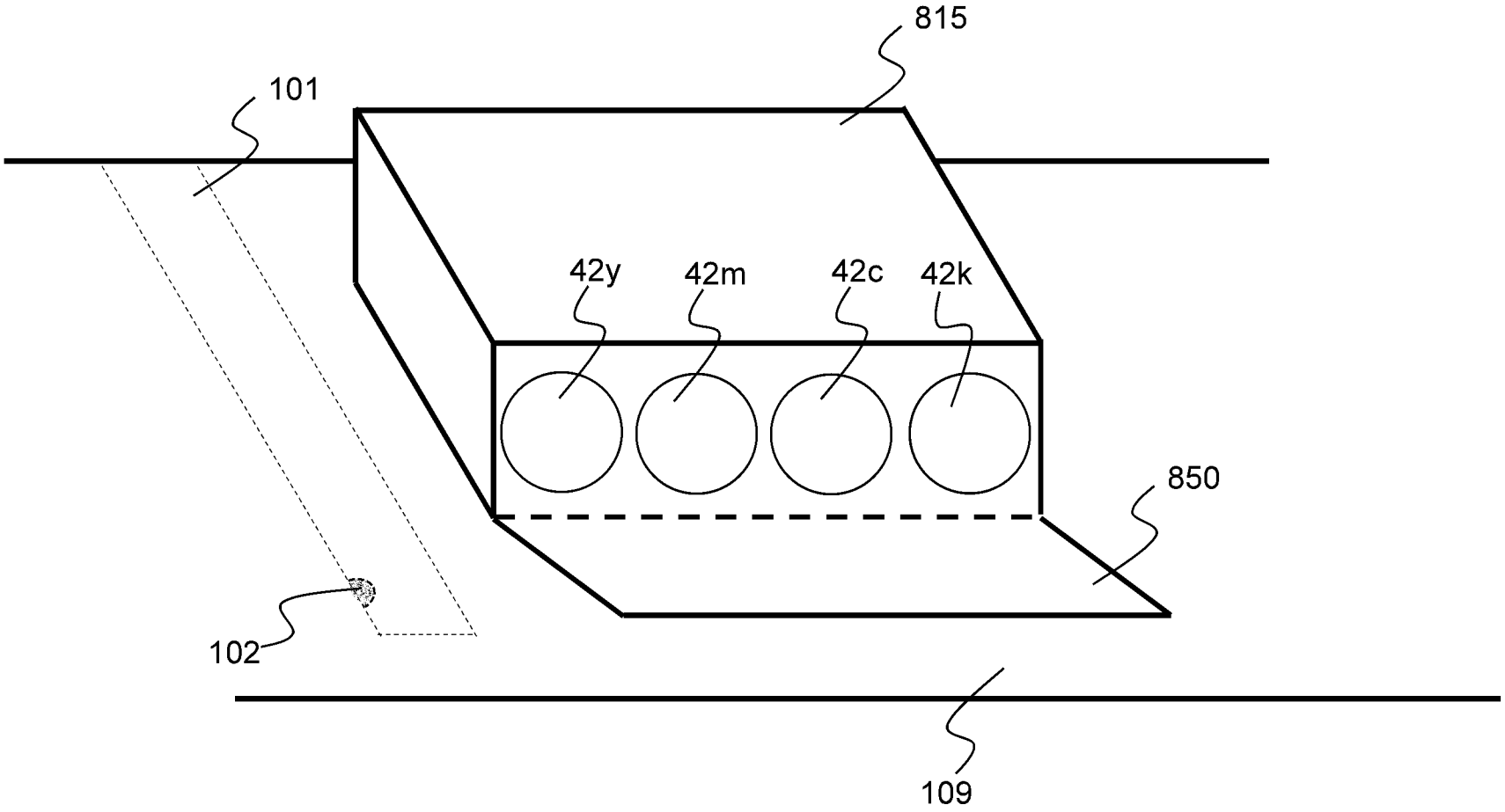

FIG. 13 is a schematic view for illustrating a bottle accommodating portion provided on a top surface.

DESCRIPTION OF THE EMBODIMENTS

In the following, embodiments for carrying out the present invention will be described with reference to the drawings. Incidentally, as regards dimensions, materials, shapes and relative arrangement of constituent elements described in the following embodiments, the scope of the present invention is not intended to be limited to only those in the following embodiments.

Embodiment 1

Image Forming Apparatus

Figure 1:
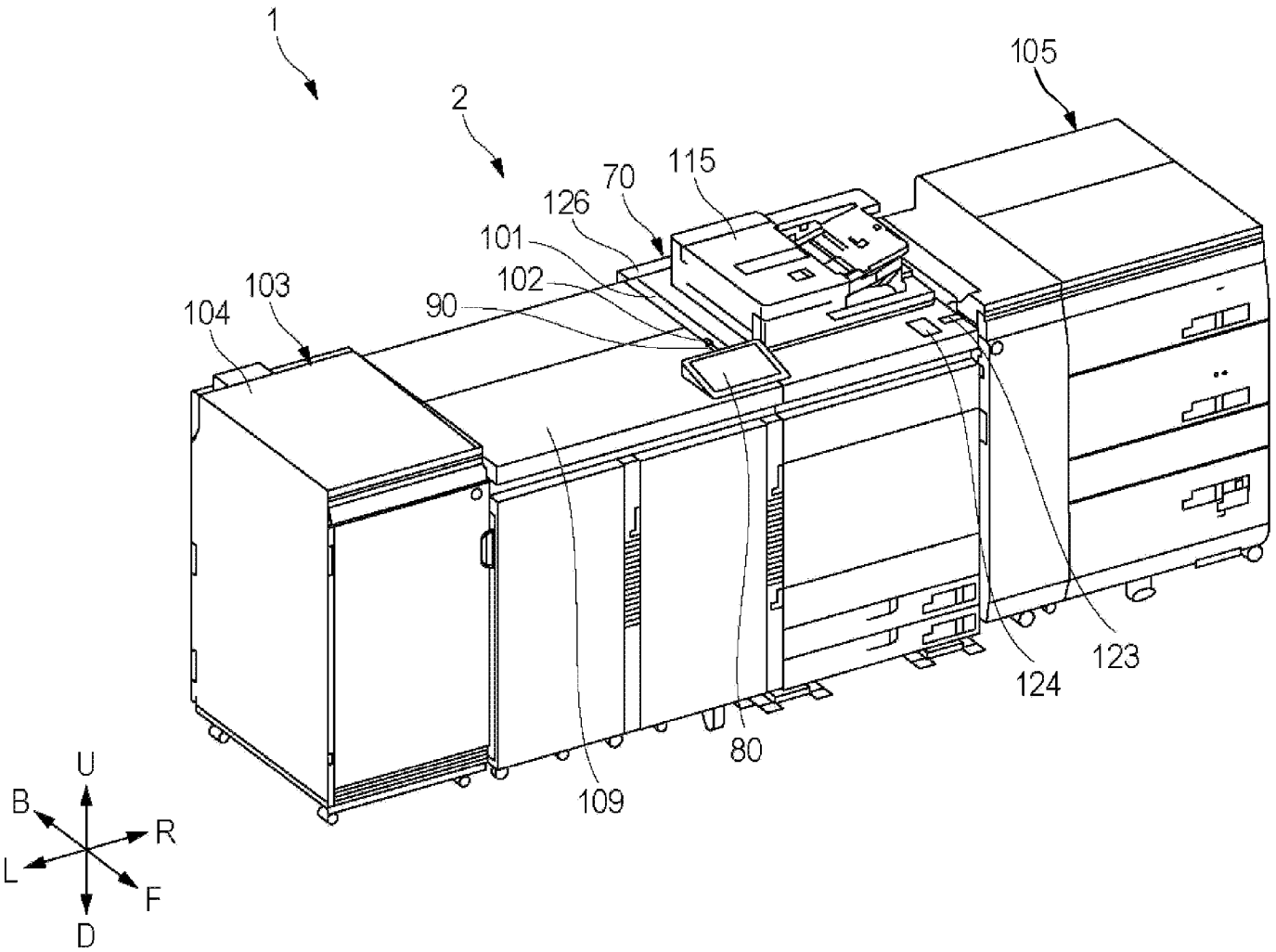
FIG. 1 is a schematic sectional view of an image forming system.

As shown in FIG. 1, an image forming system 1 according to this embodiment includes, for example, an image forming apparatus 2 which is a printer and includes a post-processing device 103 which is provided adjacent to the image forming apparatus 2 on a leftward direction (L) side and on which sheets S are capable of being stacked. Incidentally, in this embodiment, the image forming apparatus 1, the post-processing device 103 and the like are defined as a casing. Further, in this embodiment, as shown in FIG. 2, when the image forming apparatus 2 is viewed, a front side is defined as a front (forward) direction F, a rear (back) side is defined as a rear (backward) direction B, a left side is defined as a left (leftward) direction L, a right side is defined as a right (rightward) direction R, an upper side is defined as an upward direction U, and a lower (down) side is defined as a downward direction D.

As shown in FIG. 1, at an upper surface of the image forming apparatus 2, a top surface 109 usable as an operating space (workspace) is provided. In this embodiment, the top surface 109 is constituted in an area broader than a maximum size (for example, A3 size) of the sheet S on which an image can be formed by the image forming apparatus 2. A user using the image forming system 1 performs, for example, an operation such that a drawing is spread out on the top surface 109 and drafting or the like is carried out. Accordingly, the top surface 109 is a flat horizontal surface to the extent possible. Here, a region indicated by a reference 1010 in part (a) of FIG. 5 described later is an example of the operating space. When the image forming system 1 is installed horizontally, the operating space 1010 is also horizontal. Further, in this region, a flat surface which is designed so as to minimize an uneven portion such as grooves except for a connecting portion between members inevitably formed in view of design off an outer casing of the image forming system 1 and which is formed as flat as possible is constituted. The operating space 1010 is sufficient when the operating space 1010 includes a region such that at least an A3-size sheet can be spread out and may only be required that a flat surface is ensured in this region. Incidentally, the top surface 109 is constituted by a plate made of, for example, a resin material and is regarded as "being a flat surface" even when looseness or waviness to the extent that they inevitably occur in manufacturing exist. Further, the "horizontal" referred to herein is not "horizontal" in a strictly mathematical sense, but is a concept including "horizontal" to the extent that the surface can be regarded as being practically horizontal, i.e., substantially horizontal.

In this embodiment, as an example of the image forming apparatus 2, a full-color printer of a tandem type is described. However, in the present invention, the image forming apparatus 2 is not limited to the image forming apparatus 2 of the tandem type, but may also be an image forming apparatus of another type. Further, the image forming apparatus 2 is not limited to the full-color image forming apparatus, but may also be a monochromatic or mono-color image forming apparatus.

Further, on the top surface 109 of the image forming apparatus 2, a scanner device 115 is provided. The scanner device 115 is constituted by an original feeding device 750 for feeding an original on which an image thereof should be read and by an image reading device (apparatus) 751 (an example of a reader) for reading the image of the original. The scanner device 115 may be a device with which the image forming apparatus 2 is provided and may also be optional device for which the user is capable of discriminating whether or not the option device should be installed. That is, the scanner device 115 may also have a constitution in which the option device 115 can be purchased separately from the image forming apparatus 2 and is capable of being retrofitted to the image forming apparatus 2. In this embodiment, a system including the scanner device 115 is referred to as the image forming system 1.

Parts (a) and (b) of FIG. 2 are schematic views for illustrating the scanner device 115 in this embodiment. Part (a) of FIG. 2 shows a state in which the original feeding device 750 (an example of an openable portion) is in an open position where the original feeding device 750 is open relative to the image reading device 751. On the other hand, part (b) of FIG. 2 shows a state in which the original feeding device 750 is in a closed position where the original feeding device 750 is closed relative to the image reading device 751. Thus, the original feeding device 750 is provided so as to be openable (and closable) relative to the image reading device 751. A rotational axis direction of the original feeding device 750 is substantially parallel to a left-right direction of the image forming system 1. A rotational axis of the original feeding device 750 is positioned on a rear side of the original feeding device 750. Accordingly, when the user stands in front of the image forming system 1, the user grasps a front surface of the original feeding device 750 and then raises the original feeding device 750, whereby the original feeding device 750 is capable of being moved from the closed position toward the open position.

The type of the scanner device 115 includes a fixed reading type in which an original is set on the image reading device 751 and an image of the original is read while moving an unshown image reading means and a skimming-through reading type in which the image is read while feeding originals one by one by using the original feeding device 750.

In the fixed reading type, the original is set on an original supporting platen glass 753 provided on the image reading device 751 and then the image of the original is read while moving the image reading means. At this time, floating such as crease generating on the original is prevented by pressing the original against the original supporting platen glass 753 by a white plate 752 provided at a lower surface of the original feeding device 750.

On the other hand, in the skimming-through reading type, the originals stacked on a tray of the original feeding device 750 are separated one by one by an unshown pick-up roller and then the separated card reader is fed into the original feeding device 750. The original fed in the original feeding device 750 is subjected to reading of the image of the original by the image reading means.

Here, the original feeding device 750 functions as an openable portion for opening and closing the image reading device 751, but there is no need that the openable portion has a function of feeding the original. That is, a cover in general movable between the open position where the image reading device 751 is open and the closed position where the original reading platen glass 753 is covered (closed) is defined as the "openable portion".

FIG. 3 is a schematic sectional view of the image forming system 1. As shown in FIG. 3, in this embodiment, the image forming apparatus 2 which is an example of a casing can be divided into two portions consisting of an image forming portion casing 2*a* and a feeding portion casing 2*b*. In the feeding portion casing 2*b*, the sheet on which the image is formed in the image forming portion casing 2*a* is fed toward an unshown post-processing device 103. Each of the image forming portion casing 2*a* and the feeding portion casing 2*b* is an example of the casing. The image forming portion casing 2*a* has a top surface 109*a*, and the feeding portion casing 2*b* has a top surface 109*b*. The image forming portion casing 2*a* and the feeding portion casing 2*b* can be connected to each other, so that the top surface 109*a* and the top surface 109*b* are also connected to each other and thus constitute the top surface 109. In this way, the image forming portion casing 2*a* and the feeding portion casing 2*b* can be connected to and separated from each other, so that in the case where, for example, these casings are transported to an upper floor of a building, these casings are placed in an elevator in a separated state and then go up to a predetermined floor. By this, even when the image forming system is a large-size image forming system 1 long in full-length, the image forming system 1 can be easily transported to the predetermined floor in the building by using the elevator or the like.

The image forming apparatus 2 includes a toner supply device 20, a sheet feeding portion 30, an image forming portion 40, a sheet conveying portion 50, a sheet discharging portion 60, an electric device (unit) 70 and an operating unit 80. Incidentally, a sheet S which is a recording material is a material on which a toner image is formed, and as a specific example thereof, there are plain paper, a synthetic resin sheet which is a substitute for the plain paper, thick paper, a sheet for an overhead projector, and the like.

The sheet feeding portion 30 is disposed at a lower portion of the image forming apparatus 2 and includes a sheet cassette 31 in which sheets S are stacked and accommodated, and a feeding roller 32, and the sheet S is fed to the image forming portion 40.

The image forming portion 40 includes image forming units 41, toner bottles 42, exposure devices 43, an intermediary transfer unit 44, secondary transfer portions 45 and a fixing device 46 and carries out image formation. Although described later, an accommodating place (portion) for the toner bottles 42 is not limited to positions shown in FIG. 3. For example, the accommodating place (portion) for the toner bottles 42 may also be provided at a top surface of the image forming apparatus 2.

The image forming units 41 comprises four image forming units 41*y*, 41*m*, 41*c* and 41*k* for forming toner images of four colors of yellow (y), magenta (m), cyan (c) and black (k). These portions are mountable in and dismountable from the image forming apparatus 2 by the user. For example, the image forming unit 41*y* includes a photosensitive drum 47*y*, a charging roller 48*y* and a developing sleeve 49*y* which are used for forming the toner image and includes an unshown drum cleaning blade, toner and the like. Further, to the image forming unit 41*y*, the toner is supplied from the toner bottle 42*y* filled with yellow toner. Further, other image forming portions 41*m*, 41*c* and 41*k* have structures similar to the structure of the image forming unit 41*y* except for the colors of toners, so that will be omitted from detailed description.

The exposure device 43*y* is an exposure means for forming an electrostatic latent image on a surface of the photosensitive drum 47*y* by exposing the surface of the photosensitive drum 47*y* to light.

The intermediary transfer unit 44 is disposed at a lower portion of the image forming unit 41. The intermediary transfer unit 44 includes a plurality of roller such as a driving roller 44*a* and primary transfer rollers 44*y*, 44*m*, 44*c* and 44*k*, and an intermediary transfer belt 44*b* wound around these rollers. The primary transfer rollers 44*y*, 44*m*, 44*c* and 44*k* are disposed opposed to the photosensitive drums 47*y*, 47*m*, 47*c* and 47*k*, respectively, and are contacted to the intermediary transfer belt 44*b*. By applying a transfer bias of a positive polarity to the intermediary transfer belt 44*b* through the primary transfer rollers 44*y*, 44*m*, 44*c* and 44*k*, so that the toner images having the negative chargeability are multiple-transferred successively from the photosensitive drums 47*y*, 47*m*, 47*c* and 47*k* onto the intermediary transfer belt 44*b*. By this, a full-color image is formed on the intermediary transfer belt 44*b*.

A secondary transfer portion 45 includes an inner secondary transfer roller 45*a* and an outer secondary transfer roller 45*b*. By applying a secondary transfer bias of the positive polarity to the outer secondary transfer roller 45*b*, the full-color image formed on the intermediary transfer belt 44*b* is transferred onto the sheet S. Incidentally, the inner secondary transfer roller 45*a* stretches the intermediary transfer belt 44*b* inside the intermediary transfer belt 44*b*, and the outer secondary transfer roller 45*b* is provided at a position where the outer secondary transfer roller 45*b* opposes the inner secondary transfer roller 45*a* through the intermediary transfer belt 44*b*.

The fixing device 46 includes a fixing roller 46*a* and a pressing roller 46*b*. The sheet S is nipped and fed between the fixing roller 46*a* and the pressing roller 46*b*, so that the toner image transferred on the sheet S is pressed and heated and thus is fixed on the sheet S. Incidentally, in this embodiment, the feeding portion casing 2*a* includes the fixing device 46, but the present invention is not limited to such a constitution. For example, a constitution in which the image forming portion casing 2*a* includes the fixing device 46 and in which the feeding portion casing 2*b* does not include the fixing device 46 may also be employed. Further, each of these casings 2*a* and 2*b* may also include the fixing device 46.

The sheet conveying portion 50 conveys the sheet S, fed from the sheet feeding portion 30, from the image forming portion 40 to the sheet discharging portion 60, and includes a pre-secondary transfer conveying passage 51, a pre-fixing conveying passage 52, a discharging passage 53 and a re-conveying passage 54.

The sheet discharging portion 60 includes a discharging roller pair 61 provided downstream of the discharging passage 53 and a discharging opening 62 formed at a left side portion of the image forming apparatus 2. The discharging roller pair 61 feeds the sheet S from a nip thereof along the discharging passage 53 and discharges the sheet S through the discharging opening 62. The discharging opening 62 permits feeding of the sheet S to the post-processing device 103 disposed on the left side of the image forming apparatus 2.

As shown in FIG. 4, the electric unit 70 includes a controller 71 which is a control board including a control portion and includes a hard disk drive (HDD) 72 which is a removable mass storage. The controller 71 is constituted by a computer and includes, for example, a CPU 73, a ROM 74 for storing programs for controlling various portions, a RAM 75 for temporarily storing data, and an input/output circuit (I/F) 76 for inputting and outputting signals between itself and an outside portion. The HDD 72 is the removable mass storage and is capable of accumulating principally an image processing program, digital image data and supplementary information on the digital image data. During image formation, the image data is read from the HDD 72.

The CPU 73 is a microprocessor managing entirety of control of the image forming apparatus 2, and is the core of a system controller. The CPU 73 is connected, through the input/output circuit 76, to the sheet feeding portion 30, the image forming portion 40, the sheet conveying portion 50, the sheet discharging portion 60, the HDD 72 and the operating unit 80, and not only transfers signals between itself and each of the portions (devices) but also controls operations of the respective portions. Further, the controller 71 is capable of causing the user to operate and make settings in accordance with an instruction from an unshown computer connected to the image forming apparatus 2, an operation of the operating unit 80, and the like.

The operating unit 80 is provided separately from the image forming apparatus 2 and is capable of operating the respective portions of the image forming apparatus 2. The operating unit 80 includes a driver board 81 and a display panel 82. The display panel 82 displays necessary information for operating the image forming apparatus 2 by the user, such as a remaining amount of the sheets S supplied to the image forming apparatus 2, a remaining amount of the toner, a warning massage when these consumables are used up, a procedure when the consumables are replenished, and the like. Further, the display panel 82 receives operation input by the user, such as settings of a size and a basis weight of the sheet S, image density adjustment, and the number of output sheets, and the like.

The operating unit 80 is connected to the electric unit 70 of the image forming apparatus 2 by the cable 90 and thus is capable of being supplied with electric power. The cable 90 is a bundle wire including a signal wire 90*a* and a power wire 90*b* which are bundles, but the signal wire 90*a* and the power wire 90*b* may also be separate cables. That is, the cable 90 referred to herein may be a power (supply) cable for supplying electric power to the operating unit 80 and may also be a communication cable for transmitting signals for permitting the operating unit 80 to establish communication. The signal line 90*a* connects the input/output circuit 76 of the controller 71 with the driver board 81, and the power line 90*b* connects a power source 12 of the image forming apparatus 2 with the driver board 81.

Next, an image forming operation in the thus-constituted image forming apparatus 2 will be described. When the image forming operation is started, first, the photosensitive drums 47*y*, 47*m*, 47*c* and 47*k* are rotated, and then the surfaces thereof are electrically charged by the charging rollers 48*y*, 48*m*, 48*c* and 48*k*. Then, on the basis of image information, the photosensitive drums 47*y*, 47*m*, 47*c* and 47*k* are exposed to laser light by the exposure devices 43*y*, 43*m*, 43*c* and 43*k*, so that electrostatic latent images are formed on the surfaces of the photosensitive drums 47*y*, 47*m*, 47*c* and 47*k*. Toners are deposited on these electrostatic latent images, so that the electrostatic latent images are developed and visualized into toner images, and then the toner images are transferred onto the intermediary transfer belt 44*b*.

On the other hand, in parallel to such a toner image forming operation, the feeding roller 32 is rotated and feeds an uppermost sheet S of the sheets S in the sheet cassette 31 while separating the uppermost sheet S. Then, the sheet S is fed to the secondary transfer portion 45 through the pre-secondary transfer conveying passage 51 by being timed to the toner images on the intermediary transfer belt 44*b*. Further, the toner images are transferred from the intermediary transfer belt 44*b* onto the sheet S, and the sheet S is fed to the fixing device 46, in which the (unfixed) toner images are heated and pressed and thus are fixed on the surface of the sheet S, so that the sheet S is discharged through the discharging opening 62 by the discharging roller pair 61 and then is supplied to the post-processing device 103.

Operating Unit

The operating unit 80 for operating the image forming system 1 by the user is connected to the electric unit 70 through the cable 90.

The electric unit 70 is provided on the rear surface of the image forming apparatus 2, and to the electric unit 70, a connector (not shown) provided on one end side of the cable 90 is connected. The cable 90 transmits a control signal for controlling the operating unit 80 from the electric unit 70 to the operating unit 80. The cable 90 performs a function of communicatably connecting the image forming apparatus 2 and the operating unit 80 to each other. The cable 90 is connected to the operating unit 80 on the other side. Thus, the operating unit 80 is connected to the image forming apparatus 2 by the cable 90 and is not fixed to the top surface 109. For that reason, the user is capable of freely mounting the operating unit 80 in an arbitrary position on the top surface 109 within a length of the cable 90. Thus, the term "freely" refers to a state in which the operating unit 80 is not fixed to the top surface 109 with, for example, screws, i.e., a constitution in which a mounting position of the operating unit 80 can be freely changed on the top surface 109. However, a portion where the operating unit 80 is fixed with the screws, a magnet or the like may also be provided on the top surface 109. The user is free as the whether or not the user uses the operating unit 80 in a state in which the operating unit 80 is fixed at the position (portion). It is only required that the operating unit 80 can be freely mounted on the top surface 109 when the screws are removed.

Parts (a) and (b) of FIG. 5 are schematic views for illustrating a mountable position of the operating unit 80 on the top surface 109. Part (a) of FIG. 5 is the schematic view of the top surface of the image forming system 1 as viewed along a vertical direction. That is, part (a) of FIG. 5 is the schematic view of the top surface 109 when the image forming system 1 is viewed in the vertical direction. The cable 90 is led out through an opening 102 formed in a cover 101 described later and is connected to the operating unit 80. The opening 102 is formed one front side of the cover 101, i.e., on a front side of the image forming system 1. Incidentally, the front side of the cover 101 referred to herein is a region on the front side than a center of the cover 101 with respect to a longitudinal direction of the cover 101. Of the cable 90, a portion exposed from the opening 102 is capable of moving freely. That is, the operating unit 80 can be freely mounted on the top surface 109 within a range in which the cable 90 is movable.

Here, the "center of the cover 101" is defined as a position where a rectilinear line connecting a frontmost edge and a rearmost edge of the cover 101 is divided into two equal parts. Even if a front edge of the cover 101 has an uneven shape, a most frontward portion is referred to as the "frontmost edge". Similarly, even if a rear edge of the cover 101 has an uneven shape, a most rearward portion is referred to as the "rearmost edge". In this way, by determining the frontmost edge and the rearmost edge, the "center of the cover 101" can be determined easily by using a ruler or a measure or the like. The thus-defined region on the front side than the center of the cover 101 is defined as a "front side of the cover 101".

Incidentally, on a portion unshown in part (a) of FIG. 5, for example, on an upper surface 104 of the post-processing device 103 or the like, the operating unit 80 can also be disposed. Further, even in a space other than the upper surface of the image forming system 1, a worktable or the like is installed in the neighborhood of the image forming system 1, and the operating unit 80 can also be disposed thereon.

Part (b) of FIG. 5 is an enlarged view of a portion where the cable 90 is led out through the opening 102. As shown in part (b) of FIG. 5, the cable 90 led out through the opening 102 extends in a direction in which the cable is spaced from the scanner device 115, i.e., extends toward the left side in part (b) of FIG. 5. By employing such a constitution, a degree of a liability that the cable 90 is caught by the original feeding device 750 of the scanner device 115 is reduced.

Part (a) of FIG. 6 includes a perspective view of the operating unit 80 and an enlarged schematic view of the display panel 82. As shown in the figure, the operating unit 80 includes a supporting table 86 provided with rubber bases **85*b*1. By providing the supporting table 86, the display panel 82 is inclined with respect to the top surface 109 by a predetermined angle. Further, the supporting table 86 includes an arm 822 provided with rubber bases 85*b*1. This arm 822 is rotatable relative to the supporting table 86. It is possible to adjust an inclination angle of the display panel 82 with respect to the top surface 109 by rotating the arm 822 relative to the supporting table 86**.

The display panel 82 includes a display surface 820 on which a screen for setting information on image formation and a printing condition, such as a button for starting copying, a setting screen of a sheet size, a setting screen of the number of sheets for printing, a display screen of a remaining toner amount, and the like. In this embodiment, the display surface 820 is provided at a portion excluding an end portion of the display panel 82, but the screen for setting the information on the image formation and the printing condition may also be displayed on an entire surface of the display panel 82. However, in either case, the inclination angle of the display surface 820 with respect to the top surface 109 means an angle formed by a portion (region corresponding to the display surface 820 in part (a) of FIG. 7) in the neighborhood of a center of the display panel 82 with respect to the top surface 109. The thus-measured inclination angle of the display surface 820 with respect to the top surface 109 is made 5° or more and 45° or less, so that good viewability for the user can be ensured.

Part (b) of FIG. 6 is a schematic view showing a back side of the operating unit 80. As shown in this figure, on the back side of the operating unit 80, a space in which the arm 822 is accommodated is formed. By accommodating the arm 822 in this space, the supporting table 86 is (directly) contacted to the top surface 109, so that the operating unit 80 is supported on the top surface 109.

Cable Accommodating Portion

Next, an accommodating portion 118 (an example of a cable accommodating portion) for accommodating the cable 90 connected to the operating unit 80 will be described. The accommodating portion 118 is a groove formed on the top surface 109.

Parts (a) and (b) of FIG. 7 are schematic views for illustrating the accommodating portion 118. Part (a) of FIG. 7 is the schematic view showing the accommodating portion 118 as viewed from the rear side of the image forming system 1. In this figure, the cover 101 for covering the accommodating portion 118 is in a removed state. Further, part (b) of FIG. 7 is the schematic view showing the accommodating portion 118 as viewed from above. Also, in this figure, the cover 101 is in the removed state. Incidentally, the cover referred to herein does not mean that the cover covers the cable 90 accommodated in the accommodating portion 118 to the extent that the cable 90 is completely out of sight. For example, a part of the cable 90 may also be in sight from a gap between an edge of the cover 101 and an edge of the accommodating portion 118.

As shown in part (a) of FIG. 7, the accommodating portion 118 has a rectangular parallelopiped shape extending in a front-rear (back) direction. Further, when the top surface 109 is viewed along a vertical direction from above the image forming system 1, with respect to a left-right direction (second direction), the accommodating portion 118 and the scanner device 115 are arranged side by side. The accommodating portion 118 is provided in the neighborhood of (within a range of about 50 cm from) the scanner device 115. For that reason, if the cable 90 is led out from the cover 101 of the accommodating portion 118 toward the scanner device 115, there is a liability that the cable 90 is caught by the openable portion such as the original feeding device 750. In order to reduce a degree of such a liability, in this embodiment, the cable 90 is led out from the cover 101 toward a side opposite from the scanner device 115.

As shown in parts (a) and (b) of FIG. 7, the cable 90 is accommodated in the accommodating portion 118 along a longitudinal direction of the accommodating portion 118, i.e., a direction (first direction) from the rear (back) surface toward the front surface of the image forming system 1. The accommodating portion 118 is provided with readers 125 for retaining the cable 90. Each of the retaining portions 125 is a band made of a plastic material, for example. The band is constituted so as to be partially disconnected (disengaged). In a state in which the band is partially disconnected, the band is wound about the cable 90 and then is fastened again. The band is fixed to a bottom of the accommodating portion 118. A fixing method of the band may be a method using a detachably mountable snap-fitting structure and may also be a method of fixing the cable 90 with an adhesive or the like. In this embodiment, the retaining portion 125 is made of the plastic material, i.e., a resin material, but may also be made of metal. However, the operating unit 80 is freely moved by the user, and therefore, there is a liability that the cable 90 is unintendedly pulled by the user. In order to prepare for such a case, the retaining portion 125 is made of the resin material, so that it is possible to reduce a degree of a liability that the cable 90 is damaged.

Incidentally, as shown in parts (a) and (b) of FIG. 7, in this embodiment, the cable 90 is fixed to the accommodating portion 118 by the plurality of retaining portions 125. However, the retaining portion 125 referred to herein refers to the retaining portion 125 provided at a position closest to the opening 102 in the accommodating portion 118. Also, as regards a positional relationship between the opening 102 and the retaining portion 125 described later, the positional relationship between the opening 102 and the retaining portion 125 closest to the opening 102 is described.

FIG. 8 is a schematic view for illustrating a constitution in which the cable 90 extends in a direction away from the scanner device 115 due to the positional relationship between the opening 102 and the retaining portion 125.

Part (a) of FIG. 8 is a sectional view when the image forming apparatus 1 is cut along the left-right direction so as to pass through the opening 102 formed in the cover 101. As shown in part (a) of FIG. 8, the opening 102 is developed on the left side of the image forming apparatus 1 than the retaining portion 125 is. Specifically, a right-side edge of the opening 102 is positioned on a left side than a right-side end of the cable 90 retained by the retaining portion 125 is. In this embodiment, the scanner device 115 is positioned on the right side than the opening 102 and the retaining portion 125 are, and therefore, the positional relationship between the opening 102 and the retaining portion 125 is set as described above, so that the cable 90 led out through the opening 102 toward an outside of the accommodating portion 118 can be led out in a direction in which the cable 90 moves away from the scanner device 115.

By doing so, it is possible to prevent that the cable 90 extends as indicated by a broken line, so that it is possible to reduce a degree of a liability that the cable 90 is caught by the original feeding device 750 or the like. Part (b) of FIG. 8 shows an example in which the operating unit 80 is mounted on the top surface 109 in front of the scanner device 115, but the cable 90 is led out through the opening 102 toward a side, with respect to the left-right direction, opposite from the side where the scanner device 115 is disposed, so that the cable 90 is prevented from being wired as indicated by a broken line.

Further, the opening 102 formed in the cover 101 is not a "hole", but is formed so as to cut away an edge of the cover 101. For that reason, when the cover 101 is mounted on the accommodating portion 118, the cover 101 forms the opening which is the hole in cooperation with the edge of the accommodating portion 118. In other words, an edge of the opening is defined by the edge of the accommodating portion 118 and the edge of the cover 101. However, the present invention is not limited to this embodiment, but the edge of the accommodating portion 118 may also be cut away and a hole may also be formed in the cover 101 itself.

Here, in the case where the cut-away portion is formed on the cover 101 side, there is no need to form the cut-away portion on the top surface 109, and therefore, the operating space can be broadly ensured. That is, in the case where the operating space on the top surface 109 is intended to be ensured as broad as possible, the cut-away portion for forming the opening 102 should be formed in the cover 101. On the other hand, when the cut-away portion is formed on the cover 101 side, in the case where the cable 90 is moved, an outer peripheral surface of the cable 90 and the cut-away portion rub with each other in some instances. Particularly, in the case where the cover 101 is not fixed to the top surface 109 and the accommodating portion 118, by moving the cable 90, there arises liability that the cover 101 is disconnected from the accommodating portion 118. Accordingly, from the viewpoint that a fixing property of the cover 101 to the accommodating portion 118 is ensured, the cut-away portion defining the opening 102 may preferably be formed at the edge of the accommodating portion 118.

Further, as shown in part (a) of FIG. 8, the opening 102 is positioned on the front side than a phantom (virtual) line 750*c* which passes through the center of the original feeding device 750 with respect to a direction from the rear surface toward the front surface of the image forming system 1 and which is parallel to the left-right direction is, and is positioned on a rear side than a phantom line 750*f* which passes through a front side-end portion of the original feeding device 750 and which is parallel to the left-right direction is.

Thus, the opening 102 is positioned on the front side than the phantom line 750*c* indicating the center of the original feeding device 750 is, so that an exposure amount of the cable 90 is reduced. In general, on the top surface 109, most of a range used as the operating space is a region on the front side of the top surface 109. Although, it is also understood from consideration of a general length of arms of users, the region on the front side of the top surface 109 is used more than a region on the rear side of the top surface 109 is. Accordingly, even if the cable 90 is led out from the rear side of the cover 101, a disadvantage such that the exposure amount of the cable 90 unnecessarily increases and thus the appearance of the cable 90 becomes poor increases. In view of this point, in this embodiment, the opening 102 is disposed on the front side than the phantom line 750*c* indicating the center of the original feeding device 750 is. In other words, with respect to the direction from the rear surface toward the front surface of the image forming system 1, the opening 102 is positioned on a side downstream of the phantom line 750*c* indicating the center of the original feeding device 750.

On the other hand, when the opening 102 is disposed on a further front side than the phantom line 750*f* indicating the front side-end portion of the original feeding device 750 is, flexure of the lead-out portion of the cable 90 becomes conspicuous. In order to enable free mounting of the operating unit 80 in a range to some extent, there is a need that the exposure amount of the cable 90 through the opening 102 is increased depending on an increase in region where free movement of the operating unit 80 is enabled. For that reason, when the opening 102 is disposed on an excessively front side of the top surface 109, the cable 90 is curved, so that rectification of the attitude of the cable 90 becomes difficult. In view of this point, in this embodiment, the opening 102 is disposed on the rear side than the phantom line 750*f* indicating the front side-end portion of the original feeding device 750 is. In other words, with respect to the direction from the rear surface toward the front surface, the opening 102 is disposed on a side upstream of the phantom line 750*f* indicating the front side-end portion of the original feeding device 750.

Positional Relationship Between Opening and Retaining Portion

Parts (a) and (b) of FIG. 9 are schematic views for illustrating a positional relationship between the opening 102 and the retaining portion 125. These figures are sectional views when the image forming system 1 is cut along the left-right direction so as to pass through the opening 102 and the retaining portion 125. As shown in parts (a) and (b) of FIG. 9, the retaining portion 125 presses the cable 90 against a bottom of the accommodating portion 118. In general, coating of the cable 90 is an insulating material comprising vinyl chloride, polyethylene or the like as a main component and has appropriate elasticity. For that reason, the cable 90 is somewhat deformed by being pressed against the bottom of the accommodating portion 118 by the retaining portion 125, so that movement of the cable 90 in the left-right direction is restricted.

A position of a broken line 102L shown in part (a) of FIG. 9 is a left side-edge of the opening 102. That is, of an edge of the opening 102, the position of the broken line 102L indicates a position of an "edge portion" on a side far from the side where the original feeding device 750 is disposed with respect to a perpendicular direction (substantially parallel to the left-right direction) perpendicular to both the direction from the rear surface toward the front surface of the image forming system 1 and the vertical direction. Thus, the "edge portion" referred to herein refers to a leftmost portion of the opening 102 (including 102R and 102L) in part (a) of FIG. 9. Incidentally, the opening 102 is a portion through which the cable 90 passes, and therefore, the "edge portion" is also a portion capable of contacting the cable 90.

Further, a position of a broken line 102R shown in part (a) of FIG. 9 is a right side-edge of the opening 102. That is, the position of the broken line 102L indicates a position of an "edge portion" on a side close to the side where the original feeding device 750 is disposed with respect to a perpendicular direction (substantially parallel to the left-right direction) perpendicular to both the direction from the rear surface toward the front surface of the image forming system 1 and the vertical direction. Thus, the "edge portion" referred to herein refers to a rightmost portion of the opening 102 (including 102R and 102L) in part (a) of FIG. 9. Incidentally, the opening 102 is a portion through which the cable 90 passes, and therefore, this "edge portion" is also a portion capable of contacting the cable 90.

A position of a broken line 90L shown in part (a) of FIG. 9 is a portion of the cable 90 retained by the retaining portion 125. Particularly, the broken line 90L indicates a position of an "end portion" of the outer peripheral surface of the cable 90 on a side opposite from the side where the original feeding device 750 is disposed. That is, the "end portion" defined herein refers to a leftmost portion of the cable 90 shown in part (b) of FIG. 9.

Further, a position of a broken line 90R shown in part (a) of FIG. 9 is a portion of the cable 90 retained by the retaining portion 125. Particularly, the broken line 90L indicates a position of an "end portion" of the outer peripheral surface of the cable 90 on the side where the original feeding device 750 is disposed. That is, the "end portion" defined herein refers to a rightmost portion of the cable 90 shown in part (b) of FIG. 9.

As described above, the position of the broken line 102L and the position of the broken line 102R are defined as the positions of the edge portions of the opening 102. Further, the position of the broken line 90L and the position of the broken line 90R are defined as the positions of the end portions of the outer peripheral surface of the cable 90. At this time, the position 102R of the right side-edge portion of the edge of the opening 102 is disposed on the left side than the position 90R of the right side-end portion of the cable 90 is, i.e., on a side opposite from the side where the original feeding device 750 is disposed. By this, the attitude of the cable 90 is rectified by the right side-edge portion of the opening 102 so as to be led out toward the left side through the opening 102. Accordingly, it is possible to reduce a degree of liability that the cable 90 is led out toward the side where the original feeding device 750 is disposed.

The cable 90 is retained in the accommodating portion 118 by the retaining portion 125 during manufacturing of the image forming apparatus 2. Accordingly, as shown in FIG. 9, the case where some gap is formed between the retaining portion 125 and the cable 90 would be considered. Here, part (b) of FIG. 9 shows a state in which the cable 90 is shifted to the left side in the retaining portion 125, i.e., a state in which the cable 90 is shifted in the direction in which the cable 90 is moved away from the original feeding device 750. In this state, the cable 90 retained in the accommodating portion 118 by the retaining portion 125 in some instances.

In part (b) of FIG. 9, although the cable 90 is shifted to the left side in the retaining portion 125, the position 102R of the right side-edge portion of the opening 102 is positioned on the side opposite from the side where the original feeding device 750 is disposed than the position 90R of the right side-end portion of the cable 90 is. Even when the cable 90 is shifted to the left side to any extent, the cable 90 and the left side-portion of the retaining portion 125 contact each other, and therefore, the position 90R of the right side-end portion of the cable 90 is not positioned on the side opposite from the side where the original feeding device 750 than the position 102R of the right side-edge portion of the opening 102 is.

Incidentally, the cable 90 can also be retained by the retaining portion 125 so that the right side-edge portion (102R) of the opening 102 is disposed on the left side than the left side-edge portion (90L) of the cable 90 is. By doing so, the attitude of the cable 90 can be strongly rectified leftward through the opening 102.

Here, a thickness of the cable 90 connected to the operating unit 80 may preferably be 4 mm or more and 10 mm or less. In the case where the thickness of insulating coating is considered, when the cable 90 has the thickness which is not more than the above-described degree, the user is capable of easily changing the position of the operating unit 80 on the top surface 109. Further, the user may also use a cable thinner in thickness than the above-described cable thickness range, but in that case, stiffness of the cable itself becomes weak, and therefore, the attitude of the cable itself becomes somewhat unstable. When the leftward rectification of the attitude of the cable is taken into consideration, the cable thickness may preferably be 4 mm or more.

Further, when the thickness of the cable 90 is 4 mm or more and 10 mm or less, the right side-edge portion of the opening 102 may preferably be shifted leftward than the right side-end portion of the cable 90 by a length (distance)

which is 60% or more of the cable thickness. For example, in the case where the thickness of the cable 90 is 6 mm, the right side-edge portion of the opening 102 may preferably be shifted leftward than the right side-end portion of the cable by 3.6 mm or more. By doing so, by using stiffness of the cable itself, a leading out direction of the cable 90 can be sufficiently rectified.

Constitution of Top Surface

Next, of the top surface 109, a feature of a region in front of the scanner device 115 will be described. In FIG. 1, the general structure of the image forming system 1 in this embodiment was shown. As shown in FIG. 1, in front of the scanner device 115, a USB memory inserting portion 123 (an example of a USB memory connecting portion) and a target mark 124 indicating a portion over which a card for authentication is held are provided. On a back side of the top surface 109 on which the target mark 124 is printed, a card reader for authentication (not shown) is provided.

The USB memory inserting portion 123 is utilized in a situation such that a USB memory is connected into the USB memory inserting portion 123 on an as-needed basis, such as reading out of image data, introduction of various settings, and the like, which principally utilize the USB memory. In the case of a large-size image forming system 1 such that the post-processing device 103 and the sheet feeding device 105 are mounted, when the USB memory inserting portion 123 is provided at left and right-side surfaces of the image forming apparatus 2, accessibility is poor for users who mount the post-processing provided 103 and/or the sheet feeding device 105.

On the other hand, in the case where the USB memory inserting portion 123 is provided on the rear surface of the image forming apparatus 2, when the user uses the USB memory inserting portion 123, there is a need that the user moves to the rear surface side every time, so that it is difficult to say that the accessibility is good. Further, in the case where the USB memory inserting portion 123 is disposed on the front surface of the image forming apparatus 2, there is an increasing possibility that the user unintendedly touches the USB memory in an inserted state into the USB memory inserting portion 123. In view of above, in this embodiment, the USB memory inserting portion 123 is provided in front of the scanner device 115 on the top surface 109.

FIG. 10 is an enlarged view showing a portion where the USB memory inserting portion 123 is provided. As regards the USB memory inserting portion 123, a recessed portion 123*a* is provided on the top surface 109, and therein, a USB connector 123*b* is provided obliquely upward (60° in angle between a vertically upward direction and a connector inserting direction), and between a bottom of the recessed portion 123*a* and the USB connector 123*b*, a clearance 123*c* for an unshown USB memory and an unshown USB cable. By disposing the USB memory inserting portion 123 in a shape recessed from the top surface 109, when the USB connector 123*b* is not used, for example, when the top surface 109 utilized as a space where a bundle of copy originals is temporarily placed, the USB memory inserting portion 123 does not constitute an obstacle to such a space. The USB connector 123*b* is not vertically disposed but is disposed obliquely upward with an angle less than 45° and closer to the horizontal, so that even when a foreign matter such as a clip or a staple enters the recessed portion 123*a*, the foreign matter is collected in the clearance 123*c* and thus it is possible to suppress that the foreign matter enters the USB connector 123*b*.

Reading of image data by the USB memory inserting portion 123 is a basic function for a multi-function machine in recent years, and therefore, is set as a default setting. For that reason, the USB connector 123*b* is disposed at an end most portion (the right-side portion in FIG. 1) of the top surface 109 of the image forming apparatus 2.

Next, a mounting position (place) of the target mark 124 which is a target where the card reader for authentication is disposed and over which the card for authentication is to be held will be described.

In recent years, from the viewpoint of security measures, it has been required to meet a manner of use such that "the multi-function machine is enabled to be used only by a specific user" or that "a user reaches the front of the multi-function machine and then printing is started". As one of functions thereof, a function such that the card reader for authentication is provided in the multi-function machine and a user checks a card for authentication (IC card) such as an employee identity card against the card reader for authentication and thus is allowed to use the multi-function machine is provided.

In view of the function of the card reader for authentication, the user holds the IC card over the card reader for authentication for a certain time in a state in which the user faces the card reader for authentication. When usability is taken into consideration, it is desirable that a detecting surface of the card reader for authentication is provided so as to be oriented in an upward direction and the user has access the card reader for authentication so as to place the IC card on the detecting surface or to hole the IC card over the detecting surface. Therefore, in this embodiment, a constitution in which an accommodating space for the card reader for authentication is provided so as to be buried inside the top surface 109 of the image forming apparatus 2 is employed. The target mark 124 may be directly printed on the top surface 109 or may also be in the form of, for example, a transparent sheet sticked to the top surface 109.

A structure of the top surface 109 on which the target mark 124 is printed is shown in parts (a) and (b) of FIG. 11. Part (a) of FIG. 11 is a top (plan) view showing an inside of the top surface 109 in the case where the top surface 109 is not shown. Part (b) of FIG. 11 is a sectional view of the target mark 124 cut along a direction parallel to the direction from the rear surface toward the front surface so as to pass through the target mark 124.

The top surface 109 is provided with a recessed portion 126 where the target mark 124 is disposed. Inside the top surface 109, a card reader holding portion 124*d* is provided and fixed to the top surface 109 with screws 124*f* A wireless communication module 124*b* which is an example of the card reader for authentication is accommodated inside card reader holding portion 124*d*. A communicatable distance of the wireless communication module 124*b* is relatively short, and therefore, there is a need that the card for authentication is brought near to the target mark 124. However, the wireless communication module 124*b* is different in module employed depending on users, and therefore, the wireless communication module 124*b* is pressed against the top surface 109 by a card reader spacer 124*e* made of an elastic member. A card reader cable 124*c* connected to the wireless communication module 124*b* is connected to the controller 71 through a relay cable 124*g*. Incidentally, the card reader cable 124*c* may also be connected directly to the controller 71.

The necessity or unnecessity of the wireless communication module 124*b* is different depending on a manner of use by the user and an installing place of the image forming apparatus 2. For that reason, the wireless communication module 124*b* is not standard (default) setting but is selection setting. However, with increasing security consciousness in recent years, an installation rate of the wireless communication module 124*b* in high particularly in the case where the image forming apparatus 2 is introduced into a large size office or in the like case. For that reason, the wireless communication module 124*b* is disposed in a second place from an end portion (rightmost end portion in FIG. 1) of the top surface 109 of the image forming apparatus 2, i.e., at a position next to the USB connector 123.

Next, arrangement of a communication device (BLE/NFC) for mobile cooperation will be described. With the spread of a mobile device (notebook PC, smartphone or the like), a method capable of simply connecting the mobile provided with wireless LAN mounted in the image forming apparatus has been required. As a specific method, it is possible to cite a device authentication function by NFC (near field communication) or Bluetooth (registered trademark) LE (low energy) (BLE).

The NFC permits an identification name (data) of the wireless LAN mounted in the image forming apparatus to the mobile device (side) by bringing the mobile device near to an NFC module of the image forming apparatus (side).

The NFC is required that the mobile device is brought near to the NFC module as needed, and therefore, the NFC module may desirably be provided at an upper portion of a main assembly of the image forming apparatus.

On the other hand, in the Bluetooth LE (BLE), in addition to transmission of the identification name of the wireless LAN mounted in the image forming apparatus enabled similarly as in the NFC even in a state in which the mobile device is spaced from a BLE module by several meters, it is possible to provide a beacon function automatically presented by a dedicated application for the printer positioned in the neighborhood of the mobile device. In addition, in the BLE (Bluetooth LE), it is possible to discriminate from communication (radio) field intensity that the mobile device is close to the BLE module, and on condition that the mobile device is close to the BLE module, discrimination that "the user intends to use the image forming apparatus" is made, and a function such as cooperation with an address book is released.

In the BLE, it is also assumed that the mobile device is operated in a cooperation state when the mobile device is brought near to the BLE module, and therefore, the BLE module may desirably be disposed on an upper surface so that the mobile device is placed and then can be operated on the upper surface.

Structures of the NFC and the BLE are shown in parts (a) to (c) of FIG. 12. Part (a) of FIG. 12 is a top view of an inside of the top surface 109 in a state in which the top surface 109 is not shown. Parts (b) and (c) of FIG. 12 are perspective views of the BLE and the NFC, respectively.

A BLE unit 137 has both of a wireless LAN function and a Bluetooth communication function. The BLE unit 137 is connected to the controller 71 via a cable 137*a*. The BLE unit 137 is attenuated in radio wave when the BLE unit 137 is excessively close to a metal surface of a frame or the like, and therefore, there is a need to be spaced from the frame by a certain distance. Therefore, in this embodiment, the BLE unit 137 is fixed to the frame in a state in which the certain distance is ensured by struts 137*b* and 137*c*. In this embodiment, the BLE 137 is connected to the controller 71 via the cable 137*a*, but may also be connected to the controller 71 via a relay cable.

An NFC unit 138 is connected to the controller 71 via a cable 138*a*. A communicatable distance of the NFC unit 138 similar to the wireless communication module 124*b* is short, and therefore, there is a need to bring the NFC unit 138 near to the top surface 109. Different from the wireless communication module 124*b*, the NFC unit 138 is constituted by a dedicated substrate (board), and therefore, the NFC unit 138 is disposed so as to be bright near to the top surface 109 by a substrate holder 138*b* and struts 138*c*.

In this embodiment, the NFC unit 138 is connected to the controller 71 via the cable 138*a* but may also be connected to the controller 71 via a relay cable similarly as in the case of the wireless communication module 124*b* or via another substrate.

A communication device for cooperation with the mobile device is less selected for the image forming apparatus installed in an environment used by a fixed user in view of purposes thereof, and a specific user in a free address environment or the like selects such a communication device. For that reason, an installation rate of the communication device for cooperation with the mobile device is low compared with the communication device for user authentication. For that reason, the communication device for cooperation with the mobile device is disposed on a third place of the end portion (rightmost end portion in FIG. 12) of the top surface 109 of the image forming apparatus 2, i.e., is disposed next to the wireless communication module 124*b* disposed next to the USB connector 123.

In this embodiment, the BLE unit 137 and the NFC unit 138 were disposed from the right side in a named order, but may also be reversely disposed or disposed in parallel along the front-rear direction.

Further, different from the wireless communication module 124*b*, the communication device for cooperation with the mobile device is not used every time, and therefore, a priority of arrangement at the upper surface becomes low. When such a communication device is disposed in the third place and at the upper portion of the apparatus main assembly, the substrate thereof may also be disposed so that the user has access thereto from the front side of the image forming apparatus.

As described above, in the large-size image forming system such that the image forming apparatus is provided with option devices relating to the sheet subjected to image formation, such as the sheet feeding unit, the conveying unit, the post-processing unit and the like, it is possible to provide a space of a broader and flat top surface 109 depending on function selection by the user by installing the USB connector 123 which is the standard setting, the wireless communication module 124 which is the selection setting and which is high in installation rate and the BLE 137/NFC 138 which are the selection settings and which are relatively low in installation rate, at the top surface 109 in a named order from the outermost side (rightmost and in this embodiment) with respect to a widthwise direction of the main assembly of the image forming apparatus.

Specifically, for example, if the user does not need all the selection setting functions, an entire space between the operating unit 80 and the USB memory inserting portion 123 can be used as the operating space. If the user selects and installs only the wireless communication module 124*b* high in installation rate, an entire space between the operating unit 80 and the wireless communication module 124*b* can be used as the operating space.

Further, by disposing all the USB connector 123, the wireless communication module 124*b* and the BLE 137/NFC 138 so as not to project upward, as regards a limited operation such that an original is temporarily placed on the top surface 109 or the like operation, it is possible to provide a space for the limited operation, as a space which does not impair the user's operation.

Embodiment 2

In the embodiment 1, the constitution in which the phenomenon that the cable 90 is caught by the original feeding device 750 which is the openable portion of the scanner device 115 is prevented was described. Here, depending on a kind of the image forming system 1, the image forming system 1 is not provided with the scanner device 115 in some instances. Although described later specifically, even such an image forming system 1 is provided on the top surface 109 with a bottle accommodating portion 815 for accommodating the toner bottles 42*y* to 42*k* in some cases. In this embodiment, a constitution for preventing that the cable 90 is caught by a cover (an example of a bottle openable portion) 850 of the bottle accommodating portion 815 will be described.

FIG. 13 is a schematic view for illustrating the bottle accommodating portion 815 provided on the top surface 109. As shown in FIG. 13, in the bottle accommodating portion 815, the toner bottles 42*y* to 42*k* for the respective colors are accommodated. From each of these toner bottles 42, the toner is supplied to the associated one of the developing devices disposed inside the image forming apparatus 2.

On the front surface of the bottle accommodating portion 815, the cover 850 rotatable about a lower end as a rotation axis (shaft) is provided. A user or a service person opens this cover 850 and performs an exchanging operation of the toner bottle 42.

The structures of the cover 101 and the opening 102 are similar to the structures described in the embodiment 1, and therefore, will be omitted from description. Even in a state in which the cover 850 is opened, the cable 90 connected to the operating unit 80 extends toward the left side through the opening 102, i.e., toward the side opposite from the side where the cover 850 is disposed. For that reason, a degree of a liability that the cable 90 is nipped (caught) between the cover 850 and the top surface 109 can be reduced.

Also, a positional relationship between the opening 102 and the cover 850 is similar to the positional relationship in the embodiment 1. That is, in a state in which the cover 850 is open, with respect to the direction from the rear surface toward the front surface of the image forming system 1, the opening 102 is positioned on the front side than a center of the cover 850 is. Further, in the state in which the cover 850 is open, the opening 102 is provided so as to be positioned on the rear side than a front side-end portion of the cover 850 is.

As described above, in the embodiments 1 and 2, an example in which with respect to the left-right direction of the image forming system 1, the original feeding device 750 (or the bottle accommodating portion 815), the retaining portion 125 and the opening 102 and disposed in a named order from the right side was described, but this positional relationship may also be reversed. That is, a constitution in which with respect to the left-right direction of the image forming system 1, the original feeding device 750 (or the bottle accommodating portion 815), the retaining portion 125 and the opening 102 are disposed in the named order from the left side may also be employed. In this case, the left side-edge portion of the edge of the opening 102 is positioned on the right side than the left side-end portion of the outer peripheral surface of the cable 90. By doing so, similarly as in the above-described embodiments, the cable 90 can be led out through the opening 102 toward the side opposite from the side where the original feeding device 750 (or the bottle accommodating portion 815) is disposed. Accordingly, it is possible to reduce the degree of the liability that the cable 90 is caught by the original feeding device 750 (or the bottle accommodating portion 815 (cable 850)).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-060758 filed on Mar. 30, 2020, which is hereby incorporated by reference herein in its entirety.

What is claimed is:

1. An image forming system comprising:

an image forming portion configured to form an image on a recording material;

a casing provided with the image forming portion and including a top surface;

a reading unit including a transparent portion on which an original is placed and a reading device configured to read an image of the original placed on the transparent portion;

an openable portion configured to open and close the reading unit between in a closed state and an open state;

an operating unit movably mounted on plural positions of the top surface and configured to receive an operation by a user for performing image formation by the image forming portion;

a cable configured to connect the casing and the operating unit and transmit an electric signal between the casing and the operating unit;

a cable accommodating portion provided in the top surface with respect to a vertical direction along a first direction from a rear surface toward a front surface of the image forming system and configured to accommodate the cable; and an opening provided on the top surface and through which the cable accommodated in the cable accommodating portion is led out to an outside of the cable accommodating portion, wherein the opening is positioned between the front surface and a center of the openable portion with respect to the first direction in a case where the openable portion is in the closed state.

2. The image forming system according to claim 1, wherein an end portion of the front surface of the openable portion is positioned between the front surface and the center of the openable portion with respect to the first direction in the case where the openable portion is in the closed state and the opening is positioned between the end portion of the front surface of the openable portion and a case of the openable portion.

3. The image forming system according claim 1, further comprising a plurality of retaining portions configured to retain the cable accommodated in the cable accommodating portion, wherein when the image forming system is viewed from the front surface side, a distance between a right side edge portion of the opening and a left side edge portion of the openable portion with respect to a second direction perpendicular to the first direction and a left-right direction of the casing is longer that a distance between a right side edge portion of an outer peripheral surface of the cable which is retained by the retaining portion closest to the opening with respect to the first direction and the left side edge portion of the openable portion.

4. The image forming system according to claim 3, further comprising:

a USB memory connecting portion to which a USB memory is connected and which is provided in a region of the top surface in front of the reader; and a target mark which is a target over which the user holds an IC card and which is provided in a region of the top surface in front of the reader, wherein the opening, the target mark and the USB memory connecting portion are arranged in a named order in the second direction.

5. An image forming system according to claim 1, the cable supplies electric power to the operating unit.

6. The image forming system according to claim 1, wherein a thickness of the cable is 4 mm or more and 10 mm or less.

7. The image forming system according to claim 1, wherein the opening is positioned on a left side on the openable portion with respect to a second direction perpendicular to the first direction and the vertical direction.

* * * * *